US006017195A

United States Patent [19]

Skaggs

[11] Patent Number: 6,017,195

[45] Date of Patent: Jan. 25, 2000

[54] FLUID JET EJECTOR AND EJECTION METHOD

[76] Inventor: Bill D. Skaggs, 428 W. Ghent St., Glendora, Calif. 91740-5026

[21] Appl. No.: 08/924,050

[22] Filed: Aug. 28, 1997

Related U.S. Application Data

[60] Continuation-in-part of application No. 08/854,340, May 12, 1997, Pat. No. 5,931,643, which is a division of application No. 08/217,981, Mar. 25, 1994, Pat. No. 5,628,623, which is a continuation-in-part of application No. 08/017,651, Feb. 12, 1993, abandoned

[60] Provisional application No. 60/024,806, Aug. 8, 1996.

[51] Int. Cl.[7] ..... F04F 5/44

[52] U.S. Cl. ..... 417/181; 417/182; 417/190; 417/306

[58] Field of Search ..... 417/181, 182, 417/187, 190, 306; 99/472

[56] References Cited

U.S. PATENT DOCUMENTS

| | | | |
|---|---|---|---|
| 1,002,753 | 9/1911 | Rees . | |
| 1,443,315 | 1/1923 | Ehrhart . | |
| 1,521,729 | 1/1925 | Suczek . | |
| 1,589,888 | 6/1926 | Lummis . | |
| 1,804,569 | 5/1931 | Taddiken . | |
| 2,000,741 | 5/1935 | Buckland . | |
| 2,074,480 | 3/1937 | McLean . | |
| 2,164,263 | 6/1939 | Wall . | |
| 2,382,716 | 8/1945 | Herzmark . | |
| 2,631,774 | 3/1953 | Plummer . | |
| 3,551,073 | 12/1970 | Petrouits . | |
| 3,640,645 | 2/1972 | Forsythe . | |
| 3,659,962 | 5/1972 | Zink et al. . | |
| 4,744,730 | 5/1988 | Roeder . | |
| 4,842,777 | 6/1989 | Lamort . | |
| 5,055,003 | 10/1991 | Svenson . | |
| 5,121,590 | 6/1992 | Scanlan | 53/510 |
| 5,217,038 | 6/1993 | Pinder | 417/181 |
| 5,370,069 | 12/1994 | Monroe . | |
| 5,628,623 | 5/1997 | Skaggs . | |

FOREIGN PATENT DOCUMENTS

| | | |
|---|---|---|
| 767405 | 9/1980 | U.S.S.R. . |
| 290742 | 5/1928 | United Kingdom . |

OTHER PUBLICATIONS

Tilia Ultra FoodSaver vacuum sealer; Internet address—http://cariboucry.com/fs/fs.htm; see jar sealer attachment, Feb. 1999.

Pump–N–Seal™ Vacuum Locks in Freshness, Fingerhut Catalog, p. 61.

*Primary Examiner*—Charles G. Freay
*Assistant Examiner*—Cheryl J. Tyler
*Attorney, Agent, or Firm*—Head, Johnson & Kachigian

[57] ABSTRACT

An improved vacuum apparatus and method is provided which includes a vacuum body, pump or ejector which produces a plurality of high velocity liquid jet streams of a primary fluid (liquid) such as water discharged into a convergent diffuser to draw a secondary fluid (gas) such as air into a vacuum chamber. The secondary fluid (gas) is entrained within flow spaces formed between the liquid jet streams and is carried through the diffuser by the jet streams. A secondary fluid inlet is operatively connected to an elongate hose which serves as a vacuum line for evacuating, for example, a Mason Jar, a plastic bag, other food storage container, an oil storage or receiving receptacle, or the like. The present invention is especially adapted for use as or in a vacuum seal kit or oil change kit, but not limited thereto.

17 Claims, 34 Drawing Sheets

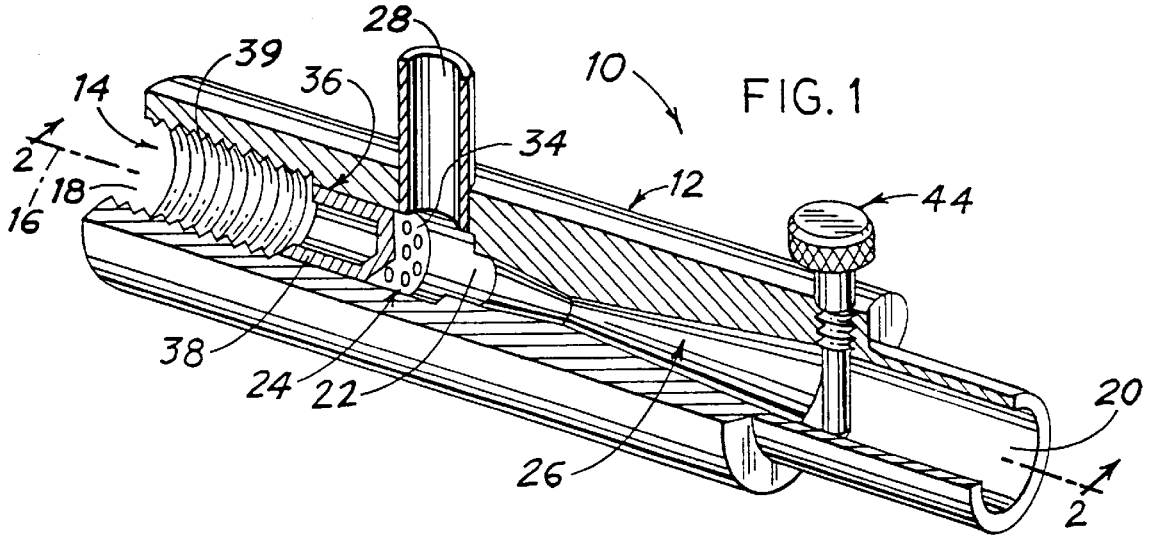
FIG. 1
FIG. 2
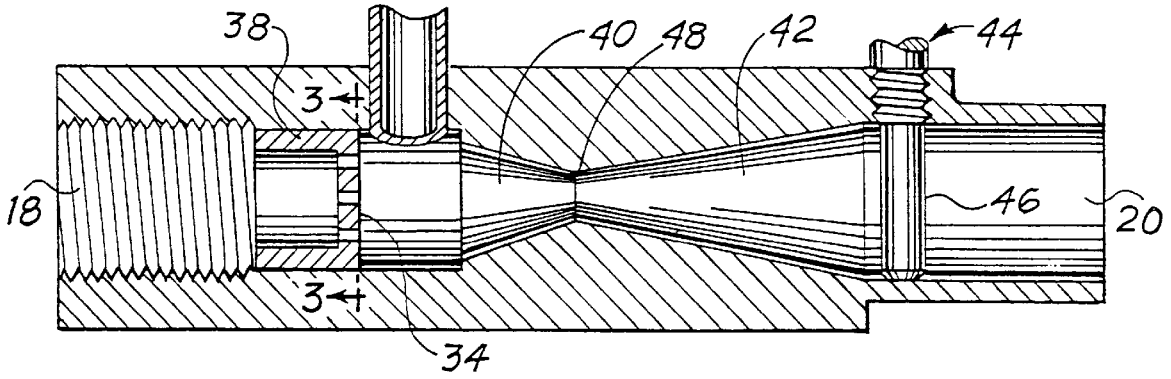
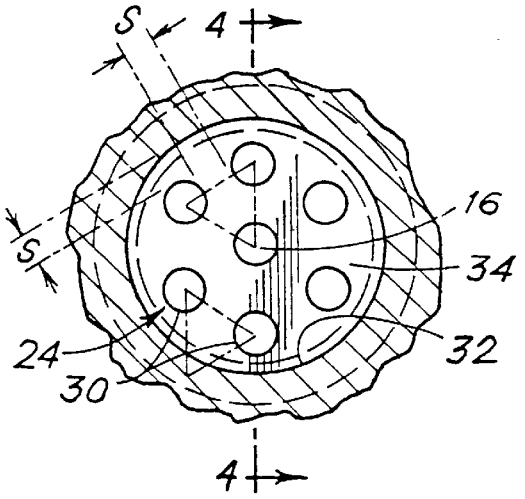
FIG. 3
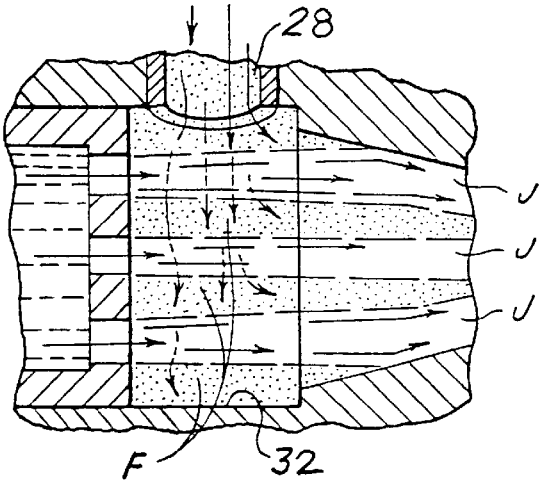
FIG. 4

FIG. 11
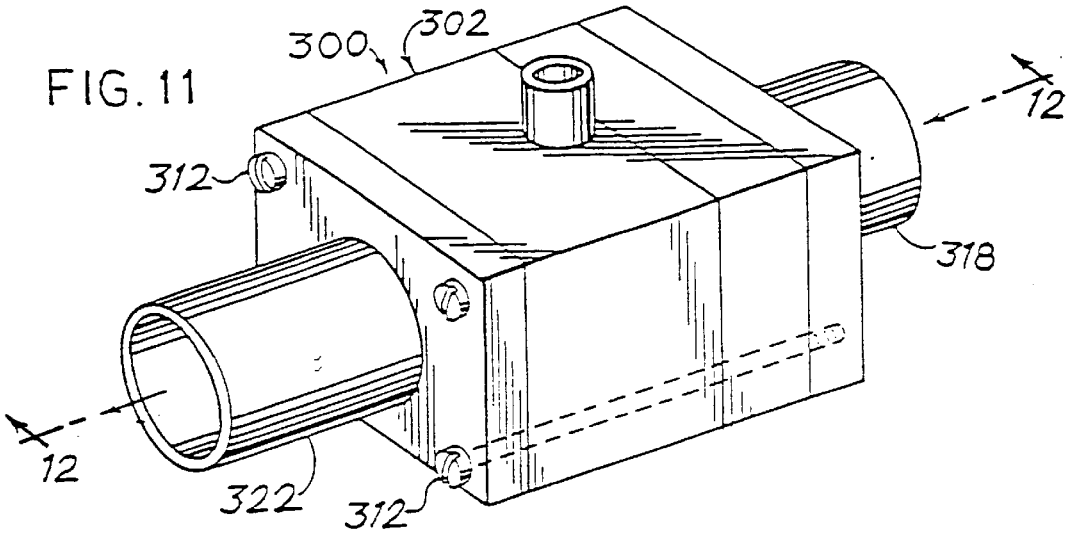
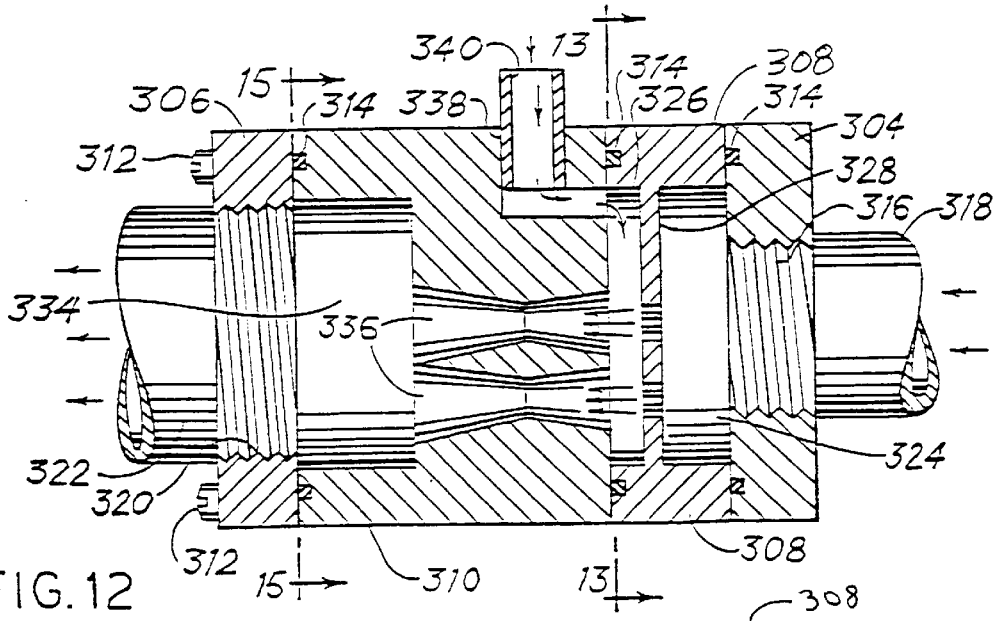
FIG. 12
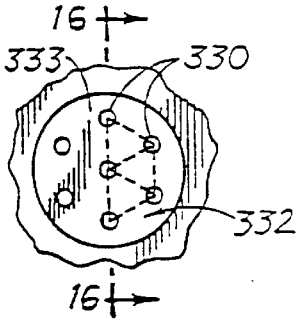
FIG. 14
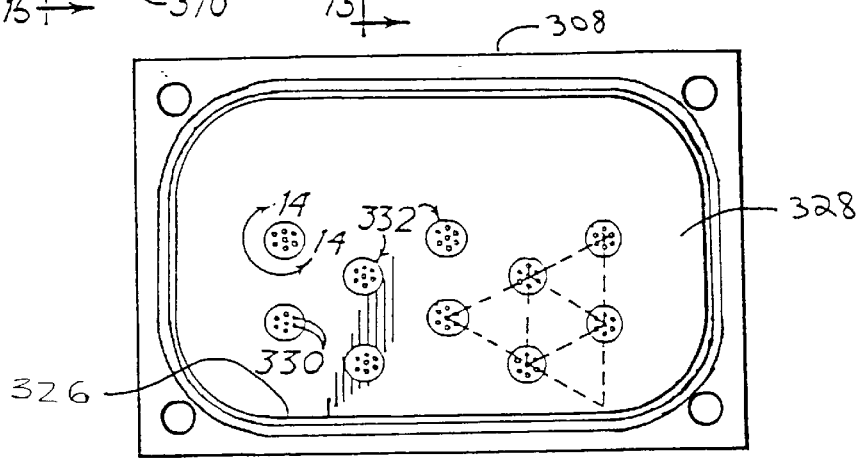
FIG. 13

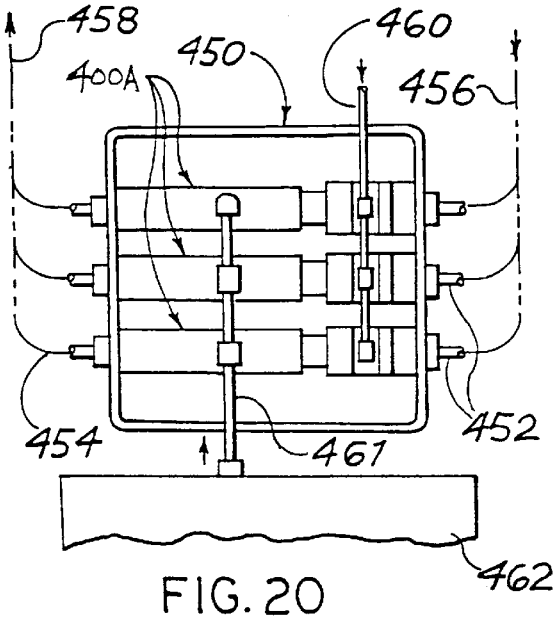
FIG. 20
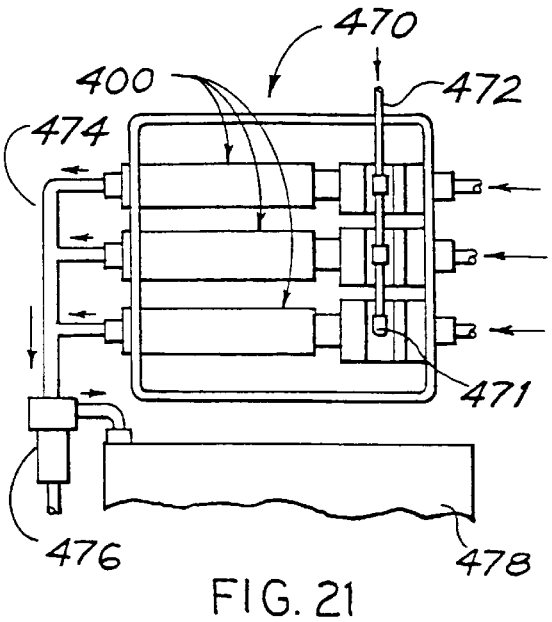
FIG. 21
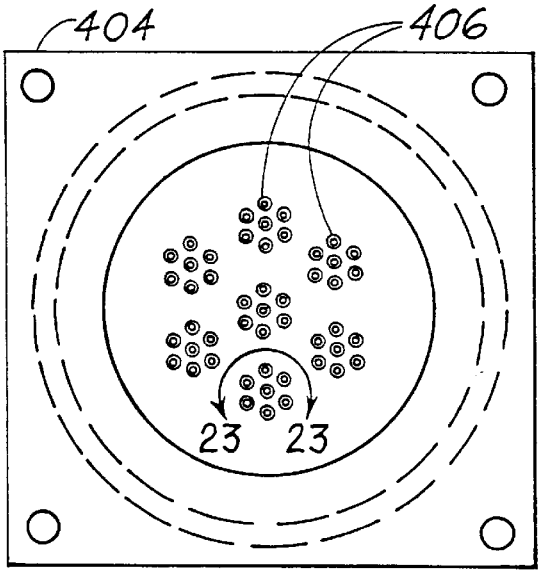
FIG. 22
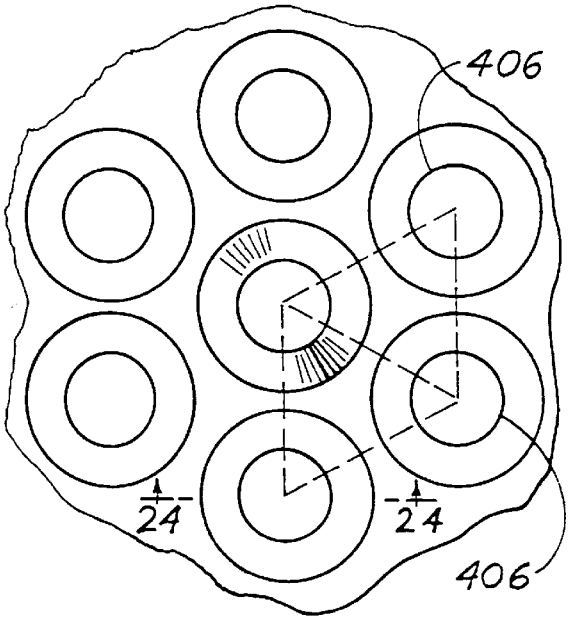
FIG. 23
FIG. 24
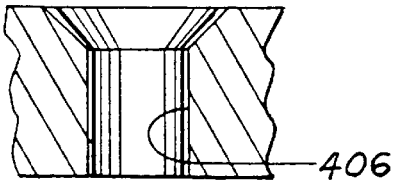

FLUID JET EJECTOR AND EJECTION METHOD

RELATED APPLICATIONS

This application is a continuation-in-part of U.S. patent application Ser. No. 08/854,340, filed May 12, 1997, now U.S. Pat. No. 5,931,643 which is a division of U.S. patent application Ser. No. 08/217,981 filed Mar. 25, 1994, now U.S. Pat. No. 5,628,623, which is a continuation-in-part of application Ser. No. 08/017,651, filed Feb. 12, 1993, now abandoned, all of which are incorporated herein by reference. This application is also a continuation-in-part of U.S. provisional patent application Ser. No. 60/024,806, filed Aug. 8, 1996, also incorporated herein by reference.

BACKGROUND OF THE INVENTION

This invention relates generally to fluid handling devices and methods, and more particularly to an improved fluid jet ejector and fluid jet ejection method. The improved fluid jet ejector may be used in several embodiments including a vacuum apparatus and method, vacuum seal or sealing kits or systems, oil evacuation or oil change kits or systems, vacuum valve assemblies, improved vacuum bodies or ejectors, or the like. More particularly, the present invention is directed to an improved fluid jet ejector, an improved home vacuum sealing kit and method, and an improved quick oil change kit and method.

Fluid jet ejectors are well known and used for a variety of purposes. Simply stated, a conventional fluid jet ejector comprises a body containing a fluid passage which forms a primary fluid inlet for receiving a pressurized primary fluid, a fluid outlet, a vacuum chamber between the inlet and outlet, a convergent-divergent diffuser communicating the vacuum chamber to the outlet, a nozzle communicating the inlet to the vacuum chamber, and a secondary fluid inlet opening to the vacuum chamber. In operation of the ejector, pressurized primary fluid enters the primary fluid inlet of the ejector and is then accelerated to a high velocity through the nozzle which discharges a high velocity jet stream of the fluid through the chamber into the convergent inlet end of the diffuser.

Acceleration of the primary fluid through the nozzle into the vacuum chamber creates a reduced pressure in the chamber which induces secondary fluid flow through the secondary fluid inlet into the chamber. The secondary fluid thus entering the vacuum chamber is drawn and entrained by and drawn into the diffuser with the high velocity fluid stream. The combined fluid undergoes acceleration and compression as it passes through the convergent inlet portion of the diffuser and deceleration and expansion as it passes through the divergent outlet portion of the diffuser.

The prior art is replete with a vast assortment of such fluid jet ejectors. Among the patents disclosing such ejectors are the following:

U.S. Pat. No. 1,521,729, dated Jan. 6, 1925 to Suczek disclosing an ejector having convergent tubes N, N1 through which a primary fluid is discharged through vacuum chambers g, r into diffusers D, D1.

U.S. Pat. No. 2,000,741, dated May 7, 1935, to Buckland disclosing a jet pump having a single nozzle 13 and diffuser 12.

U.S. Pat. No. 2,074,480, dated Mar. 23, 1937, to McLean disclosing a thermal compressor having convergent nozzles 7, 10 and a single diffuser 3.

U.S. Pat. No. 2,631,774, dated Mar. 17, 1953, to Plummer Jr. disclosing a thermocompressor having a single nozzle 22 and diffuser 16.

U.S. Pat. No. 3,551,073, dated Dec. 29, 1970 to Petrovits disclosing a jet inducer having a single nozzle 34 and diffuser 38.

U.S. Pat. No. 5,628,623, dated May 13, 1997 to Skaggs describes a fluid jet ejector and ejection method wherein a plurality of high velocity liquid jet streams of a primary fluid are discharged through a vacuum chamber into a convergent-divergent diffuser to draw a secondary fluid into the chamber. The secondary fluid is entrained within flow spaces formed between the liquid jet streams and is carried from the chamber through the diffuser by the jet streams.

Further fluid jet ejectors, injectors, or jet pumps are described for example in U.S. Pat. Nos. 1,002,753, 1,443,315, 1,589,888, 1,804,569, 2,164,263, 4,744,730, 4,842,777, 5,055,003, and 5,370,069.

U.S. Pat. No. 2,382,716 describes a compressor. U.S. Pat. Nos. 3,640,645 and 3,659,962 describe aspirators. British reference 290,742 describes an exhauster and Soviet reference 767,405 describes a gas-liquid ejector.

Typical home vacuum sealing kits such as the "Pump-N-Seal" include a hand pump unit much like a hand bicycle or tire pump which acts in reverse to draw air irom a jar or bag using a hose connected to the base of the hand pump. This device requires the user to manually create a vacuum and work against a return spring on the hand pump. Also, the hand pump unit includes a check valve which can become clogged with food or debris.

Conventional oil changing techniques require the car owner to remove the oil fill cap from the upper side of the motor, crawl under the vehicle and remove the oil drain plug, drain the used oil into an oil pan, replace the oil drain plug, refill the engine oil, replace the oil fill cap, dispose of the used oil, and clean or dispose of the oil pan. Allowing the oil to drain from the engine under the force of gravity is a time consuming, messy, and aggravating experience, to say the least.

Attempts have been made to provide oil change devices which reduce the time and inconvenience of a conventional oil change. However, these oil change devices are either slow, awkward, or expensive.

Hence, there is a need for an improved fluid jet ejector or injector and improved fluid jet injection or ejection method, industrial ejector, a vacuum apparatus and method, vacuum seal kit and method, oil change kit and method, or the like, which addresses the drawbacks of the conventional apparatus and methods.

SUMMARY OF THE INVENTION

This invention provides an improved fluid jet ejector, system, kit, and fluid jet ejection method which may be utilized with liquid or gaseous fluids, including steam, air, water, and oil, and for a variety of fluid handling purposes including vacuum pumping, fluid mixing, and fluid compression. Among the advantages of the invention are the following: ability to pull a substantially greater vacuum and in substantially reduced time; substantially increased flow volume; substantially reduced vulnerability to clogging by particulates entrained in the fluid; simplicity of construction; and, economy of manufacture.

The improved ejector of the invention has a body containing a fluid passage which includes a primary fluid inlet, an outlet, a vacuum chamber between the inlet and outlet, diffuser means communicating the chamber and outlet, a secondary fluid inlet opening to the chamber, and jet means communicating the inlet to the chamber for discharging primary fluid at high velocity through the vacuum chamber into the diffuser means. During operation of the ejector, acceleration of the primary fluid through the jet means into the vacuum chamber creates within the chamber a reduced pressure which inducee flow of secondary fluid into the chamber through the secondary fluid inlet. This entering secondary fluid is entrained within the high velocity primary fluid and is carried from the chamber through the diffuser means by the primary fluid.

According to one important aspect of the invention, the jet means comprises at least one jet group containing a plurality of jets for discharging a plurality of high velocity jet streams of the entering primary fluid through the vacuum chamber into the diffuser means. As viewed along their axes, these jets are arranged in a two dimensional array. The jets in the array include sets of jets whose arrangement is such that the jet streams issuing from the jets form within the vacuum chamber flow spaces between the adjacent jet streams. The secondary fluid entering the chamber through the secondary fluid inlet is entrained within these flow spaces and is carried from the chamber through the diffuser means by the high velocity primary fluid jet streams. One described embodiment of the invention has a single group of jets which discharge their jet streams into a common diffuser. Another described embodiment has a plurality of jet groups and an equal number of diffusers associated with the jet groups, respectively.

The preferred two-dimensional jet array contains seven jets including a central jet and outer jets uniformly spaced circumferentially about and radially from the central jet. This array forms a plurality of jet sets each containing three jets disposed in a triangular arrangement such that the jet streams issuing from the jets of each set form therebetween, within the vacuum chamber, a generally triangular flow space. The several jet streams issuing from all the jets form a plurality of such triangular flow spaces, and additional flow spaces between certain of the jet streams and the wall of the chamber. During operation of the ejector, the secondary fluid entering the vacuum chamber is entrained within these several flow spaces and is carried from the chamber with the jet streams.

One presently preferred embodiment of the invention has a single diffuser, and all of the jets discharge their primary fluid jet streams through the : vacuum chamber into this single diffuser. Another preferred embodiment of the invention has a plurality of diffusers and a plurality of jets arranged in groups associated with the diffusers, respectively. The several jets of each jet group discharge their jet streams through the vacuum chamber into the associated diffuser. In these preferred embodiments, the primary fluid jets comprise orifice openings within a wall separating the vacuum chamber from the primary fluid inlet and have parallel axes parallel to the longitudinal axis of the fluid passage through the ejector. The ejector may be operated as a vacuum pump or a fluid mixing device.

According to another aspect, the invention provides a fluid jet ejector operable as a fluid jet compressor. This ejector has a body containing a fluid passage which includes a primary fluid inlet, a primary fluid outlet, a vacuum chamber between the inlet an outlet, diffuser means communicating the chamber and outlet, a secondary fluid inlet opening to the chamber for receiving a gaseous fluid, such as air, a secondary fluid outlet opening downstream of the air/water separator and communicating with the expansion portion of the diffuser means, and fluid jet means communicating the primary fluid inlet to the chamber for discharging at least one high velocity jet stream of the entering primary fluid through the vacuum chamber into the diffuser means. During operation of this fluid ejector, secondary fluid enters the ejector through the secondary fluid inlet and exits the ejector at elevated pressure through the secondary fluid outlet.

Yet another aspect of the invention concerns a fluid jet ejector assembly comprising a plurality of individual fluid jet ejectors each having a primary fluid inlet, a fluid outlet, a vacuum chamber between the inlet and outlet, diffuser means communicating the chamber to the outlet, a secondary fluid inlet opening to the chamber, jet means for discharging at least one relatively high velocity jet stream of primary fluid through the vacuum chamber into the diffuser in a manner such that the high velocity primary fluid entrains secondary fluid entering said chamber through said secondary inlet, and secondary fluid inlet manifold connecting the secondary fluid inlets of the several ejectors to a common secondary fluid source. According to this aspect of the invention, the several ejectors are arranged in parallel to draw secondary fluid from a common secondary fluid source. In a modified embodiment of the invention, the several parallel ejectors have secondary fluid outlets opening to the outlet ends of their diffuser means and connected to a common outlet manifold for feeding fluid at elevated pressure to a common receiver. The parallel ejectors may be connected by both a common inlet manifold and a common outlet manifold.

According to a further aspect of the invention, the ejector body has a modular block-like construction and comprises several parts which are joined side by side to form the body. These parts are internally shaped so that when thus joined, the parts form the fluid passage through he body including the primary fluid inlet and outlet, fluid jet means, diffuser means, and secondary fluid inlet. Several ejectors of this type may be stacked on and along side one another to form an ejector assembly of the kind mentioned above.

A feature of the invention resides in an adjustable restricter at the outlet or expansion end of the diffuser. This restricter is adjustable to vary the back pressure at the outlet or expansion end of the diffuser and is set to prevent back flow of fluid through the diffuser past the junction of the inlet compression end and outlet expansion end of the diffuser.

Improved embodiments of the invention comprise added features for the direction of primary fluid, such as water, to a flow space defined between the exit ends of the nozzles and an exhaust tube, thus greatly improving the efficiency of the ejector device by providing sustained partial vacuum in the vacuum chamber, by preventing backflow of secondary fluid via the nozzles to the flow chamber, thus to maintain the desired low pressure therein to effect inflow of secondary fluid. Such features and components comprise a tubular passage defined about an exhaust tube and components, and means for effecting the directing of flow through said passage to said flow space.

In accordance with another exemplary embodiment of the present invention, an improved vacuum apparatus and method is provided which includes a vacuum body, pump or ejector which produces a plurality of high velocity liquid jet streams of a primary fluid (liquid) such as water discharged into a convergent diffuser to draw a secondary fluid. (gas) such as air into a vacuum chamber. The secondary fluid (gas) is entrained within flow spaces formed between the liquid jet streams and is carried through the diffuser by the jet streams. A secondary fluid inlet is operatively connected to an elongate hose which serves as a vacuum line for evacuating, for example, a Mason Jar, a plastic bag, other food storage container, an oil storage or receiving receptacle, or the like. The present invention is especially adapted for use as or in a vacuum seal kit or oil change kit, but not limited thereto.

One object of the present invention is the provision of an improved vacuum apparatus, system, kit, and/or method. Another object of the present invention is the provision of a vacuum seal kit and/or method. A still further object of the present invention is the provision of an oil change kit and/or method. A more particular object of the present invention is the provision of a small, trouble-free, easy to clean, highly efficient vacuum unit for use in homes, laboratories, medical and dental facilities, food and drug processing plants, or other industrial or commercial facilities.

Other objects and further scope of the applicability of the present invention will become apparent from the detailed description to follow, taken in conjunction with accompanying drawings wherein like parts are designated by like reference numerals.

BRIEF DESCRIPTION OF THE DRAWINGS

FIG. 1 is a longitudinal section, shown in perspective, through a fluid jet ejector according to the invention;

FIG. 2 is a section taken on line 2—2 in FIG. 1;

FIG. 3 is a section taken on line 3—3 in FIG. 2;

FIG. 4 is a section taken on line 4—4 in FIG. 3;

FIG. 11 is a perspective view of a modular fluid jet elector according to the invention;

FIG. 12 is a section taken on line 12—12 in FIG. 11;

FIG. 13 is a section taken on line 13—13 in FIG. 12;

FIG. 14 is an enlargement of the area encircled by the arrow 14—14 in FIG. 13;

FIGS. 20 and 21 are schematic side view illustrations of multiple ejector assemblies according to the invention;

FIG. 22 is a sectional view taken at line 22—22 in FIG. 18, showing a preferred form of orifices arrangement;

FIG. 23 is an enlarged fragmentary plan sectional view taken at line 23—23 in FIG. 22 and showing a jet nozzle array utilized with the invention; and FIG. 24 is a fragmentary sectional view taken at line 24—24 in FIG. 23.

FIGS. 31–44, 60–61, and 64 show the vacuum body used in both a vacuum seal kit and also a quick oil change kit.

FIG. 31 is a schematic exploded side view illustration of an exemplary vacuum seal kit in accordance with the present invention.

FIGS. 32–34, 37–38, and 42–43 are schematic drawings of the outer housing of different embodiments of the vacuum body.

FIG. 32 is an enlarged side sectional view of the vacuum body or ejector of FIG. 32.

FIGS. 33 and 34 are schematic end and side view representations of a vacuum body.

FIGS. 35 and 36 are schematic side and end view illustrations of the jet insert or nozzle body of the ejector of FIG. 31 wherein the jet is press fit into the inside of the vacuum body.

FIGS. 37–38 are schematic top view illustrations of alternative embodiments of the hydro-jet vacuum body.

FIG. 39 is a side view of an embodiment of a high pressure jet which is press fit into the vacuum body.

FIGS. 40–41 are a magnified end and side view of the jet pattern of the jet shown in FIGS. 35–36 or 39.

FIG. 42 is a blown-up top view of a hydro-jet vacuum body.

FIG. 43 is a larger view of FIG. 42 showing the flow paths of air and water.

FIGS. 44–51 are photographic representations of alternative operative arrangements of the vacuum apparatus of FIG. 31.

FIGS. 44–47 depict one operative arrangement of the apparatus. In FIG. 44, the apparatus is attached to the end of a garden hose with the water flow valve in the off position and with a large mouth Mason Jar having a partially filled balloon therein for illustrative purposes.

FIG. 45 shows the vacuum apparatus of FIG. 44 in operation with the water flow valve in the open position, water exiting the open end of the back pressure pipe, the lid over the Mason Jar, and the cap being placed over the valve and lid.

FIG. 46 shows the Mason Jar of FIGS. 44 and 45 partially evacuated.

FIG. 47 shows the Mason Jar of FIGS. 44–46 at near maximum evacuation and the balloon filling nearly the entire inner cavity of the Mason Jar.

FIGS. 48–50 depict a different operative arrangement of the apparatus with the back pressure pipe removed and the end of the pipe section between the pipe elbows being inserted into a Mason Jar. Also, a vacuum gauge has been added in the area of the relief valve to monitor the vacuum being drawn by the device.

FIG. 48 illustrates the apparatus in operation without the cap being placed over the lid and valve. Thus, the device is sucking in outside air and the vacuum gauge indicates no vacuum.

FIG. 49 illustrates the device of FIG. 48 in operation with a partial evacuation of the Mason Jar and resultant enlargement of the balloon therein.

FIG. 50 depicts the Mason Jar of FIGS. 48 and 49 almost completely evacuated and the balloon filling nearly the entire inner cavity of the Mason Jar.

FIG. 51 illustrates yet another alternative operative arrangement with the apparatus connected to an outside faucet or spigot which eliminates the need for a flow control valve. FIG. 78 shows the Mason Jar almost completely evacuated and with the balloon substantially filling the cavity thereof.

FIG. 60 is a schematic side view representation of the vacuum seal kit of FIG. 31 in one operative arrangement.

FIG. 61 is a schematic side view representation of another operative arrangement of the kit of FIG. 31.

FIG. 64 is a side view of a hydrojet vacuum oil evacuation system for removing oil from an engine.

DESCRIPTION OF THE PREFERRED EMBODIMENTS

Figure 5:
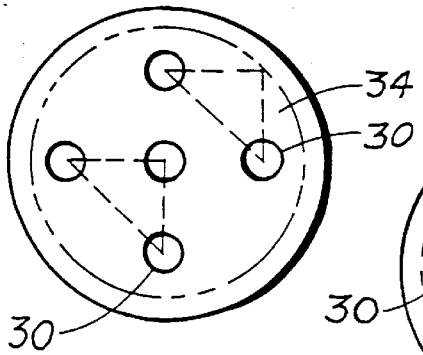
FIGS. 5–7 are views similar to FIG. 3 through modified ejector embodiments.

Referring now to the drawings and first to FIGS. 1–4, the illustrated fluid jet ejector 10 comprises a body 12 containing a fluid passage 14 having a longitudinal axis 16. Passage 12 includes a primary fluid inlet 18, a fluid outlet 20, a vacuum chamber 22 between the inlet 18 and outlet 20, jet means 24 communicating the inlet 18 to the vacuum chamber 22, convergent-divergent diffuser means 26 communicating the vacuum chamber 22 to the outlet 20, and a secondary fluid inlet 28 opening to the vacuum chamber 22.

Briefly, during operation of the ejector, pressurized primary fluid entering the primary fluid inlet 18 is accelerated through the jet means 24 and discharged at high velocity through the vacuum chamber 22 into the diffuser means 26, and exits the ejector through the outlet 20. Acceleration of the primary fluid through the vacuum chamber 22 creates a local reduced pressure in the chamber which induces flow of secondary fluid into the chamber through the secondary fluid inlet 28. The entering secondary fluid is entrained by the high velocity primary fluid passing through the vacuum chamber 22 and is carried with the primary fluid from the chamber through the diffuser means 26. During passage of the combined fluid, i.e. primary fluid and entrained secondary fluid, through the diffuser means, the fluid is first compressed within the inlet portion of the diffuser means and then expanded within the outlet portion of the diffuser means. As mentioned earlier and as will be explained in more detail later, the ejector may be operated with both liquid and gaseous fluids, including air, water, and steam, and utilized for various purposes including use as a vacuum pump, a fluid mixing device, and a fluid compressor.

According to one important aspect of the invention, the jet means 24 comprises a plurality of individual jets 30 which discharge a plurality of relatively high velocity jet streams J of primary fluid through the vacuum chamber 22 into the diffuser means 26 (FIG. 4). These several jets 30 have substantially parallel axes parallel to the fluid passage axis 16 and are arranged in a two dimensional array when viewed along their axes, as in FIG. 3. The arrangement of the jets in the array is such that the several jet streams J of primary fluid which issue from the jets are laterally spaced to form within the vacuum chamber 22 flow spaces F between the adjacent jet streams J and between certain of the jet streams and the wall of the vacuum chamber. The secondary fluid entering the vacuum chamber 22 through the secondary fluid inlet 28 is entrained within the flow spaces F by the jet streams J.

Figure 7:
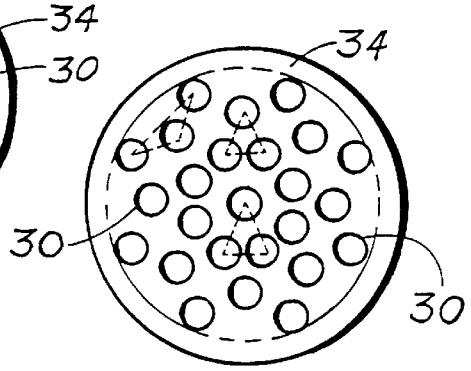
Figure 6:
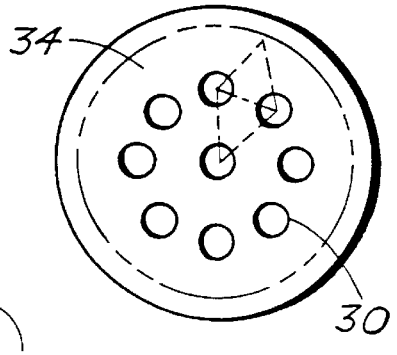

The preferred jet array is that illustrated in FIG. 3 and comprises seven jets including a central jet located on the axis 16 of the fluid passage 14, and six outer jets equally spaced about the central jet. It will be observed that this jet array includes a plurality of sets of jets 30 each including three jets disposed in a generally triangular arrangement. The three jets of each such jet set form therebetween a flow space F of generally triangular transverse cross-section. Each pair of adjacent outer jets and the vacuum chamber wall 32 form an additional flow space F. The seven jets have equal diameter which is preferably on the order of 0.052 inches. The spacing S between the adjacent outer jets and the corresponding spacing between each outer jet and the central jet are preferably equal to the jet diameter, i.e. 0.052 inches. FIGS. 5–7 illustrate other possible jet arrays including 5, 9, and 25 jets, respectively.

According to another important aspect of the invention, the several jets 30 comprise orifice-like openings through a wall 34 which separates the primary fluid inlet 18 from the vacuum chamber 22. In the preferred embodiment illustrated, this wall is an end wall of a generally cup-shaped insert 36 having a cylindrical body 38 closed at one end by the wall 34. Insert 36 is press-fitted or otherwise fixed within the fluid passage 14 between the inlet 18 and the vacuum chamber 22. The portion of the passage 14 upstream of the wall 34 forms a fluid inlet chamber 39 which is internally threaded for connection to a primary fluid infeed conduit, not shown.

In the preferred ejector embodiment of FIGS. 1–4, the diffuser means 26 comprises a single convergent-divergent diffuser that receives the jet streams from all the jets 30. This diffuser has an upstream convergent compression chamber 40 and a downstream divergent expansion chamber 42. During ejector operation, primary fluid entering through the primary fluid inlet 18 and secondary fluid entering through the secondary fluid inlet 28 and entrained in the primary fluid undergo compression and acceleration during passage through the diffuser compression chamber 40 and expansion and deceleration during passage through the diffuser expansion chamber 42.

Threaded in the ejector body 12 downstream of the diffuser expansion chamber 42, on an axis transverse to the axis 16 of the fluid passage 14, is a restricter 44. This restricter includes an inner stem 46 which extends partway across the outlet 20 to provide in the passage a restriction that creates a back pressure in the diffuser. The restricter 44 is adjustable axially to vary the restriction and thereby the back pressure. Too little back pressure will result in back flow of a gaseous fluid from the diffuser expansion chamber 42 to the vacuum chamber 22. Too much back pressure will result in back flow of a liquid fluid from the diffuser expansion chamber 42 to the vacuum chamber. The restricter stem 46 is set in a position which provides a back pressure such that the diffuser throat 48 forms a check-valve-like separation region which prevents back flow of fluid from the diffuser expansion chamber to the vacuum chamber 22. The purpose of restricter 44 is to prevent air backflow through the diffuser. The restricter may be eliminated if the exhaust tube is sufficiently long to create a sufficient back pressure, for example, 2 psi. The restricter may also be eliminated if the exhaust tube or outlet 20 is restricted to produce back pressure.

As mentioned earlier, the fluid ejector of the invention may be utilized for various purposes. For example, the secondary fluid inlet 28 of the ejector 10 may be connected to a vessel to be evacuated, and the ejector may be operated as a vacuum pump for sucking fluid from the vessel through the secondary inlet to evacuate the vessel. Alternatively, the secondary fluid inlet 28 may be connected to a source of secondary fluid to be mixed with the primary fluid supplied to the ejector. In this case, the ejector is operated as a combined pump and mixing device which receives the secondary fluid through the secondary inlet 28 and mixes the secondary fluid with the primary fluid.

Figure 10:
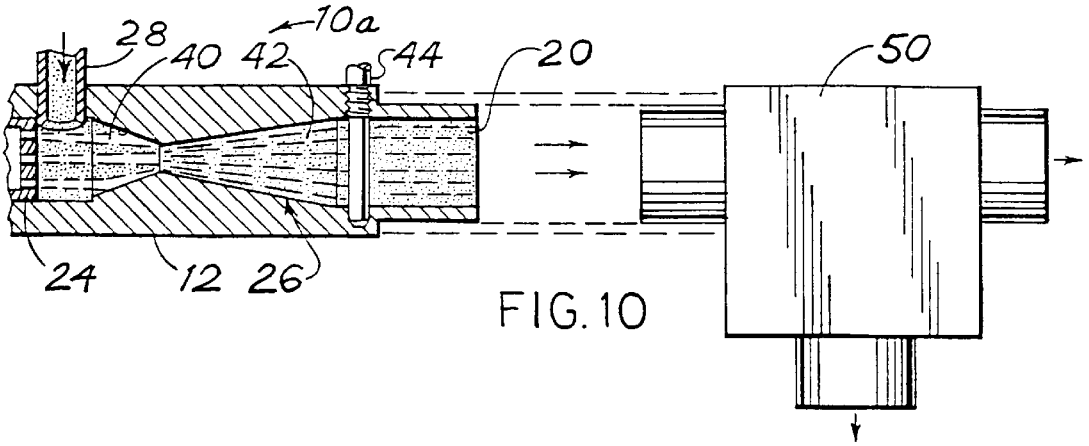
FIG. 10 is a longitudinal section through a modified fluid jet ejector according to the invention.
Figure 15:
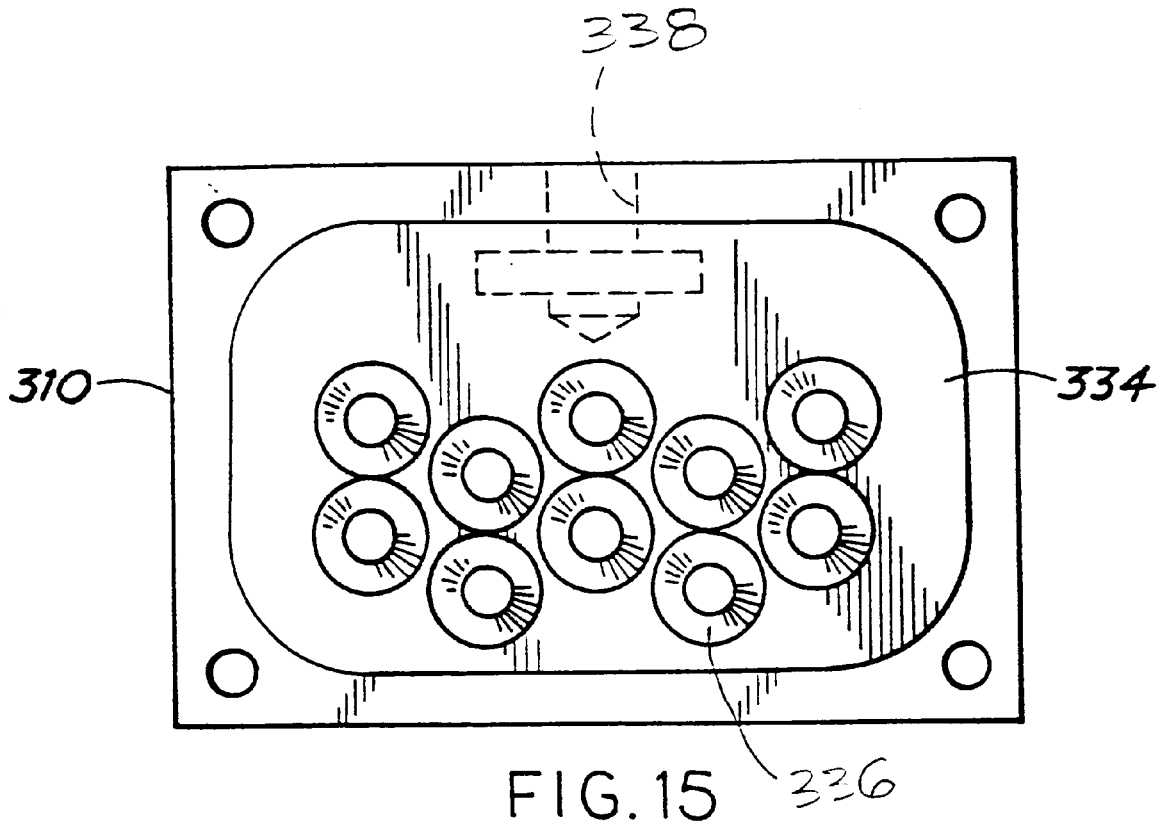
FIG. 15 is a section on line 15—15 in FIG. 12.

The modified fluid jet ejector 10A of FIG. 10 is operable as a jet compressor. Jet Compressor 10A is identical to the fluid jet ejector 10 illustrated in FIGS. 1–4 except that the jet compressor is connected to secondary outlet downstream of an air/water separator 50, for the compressed air output of the device. The secondary inlet 28 is connected to a source of gas to be compressed. This gas may be air, in which case the inlet may open to the atmosphere. The gas is entrained in the primary fluid flowing through the compressor, compressed within the diffuser 26, and exits the compressor via the separator 50. The restricter 44 of FIG. 2 is eliminated by having an exhaust tube sufficiently elongated to produce adequate back pressure, or by having a restricted exhaust tube outlet.

Figure 8:
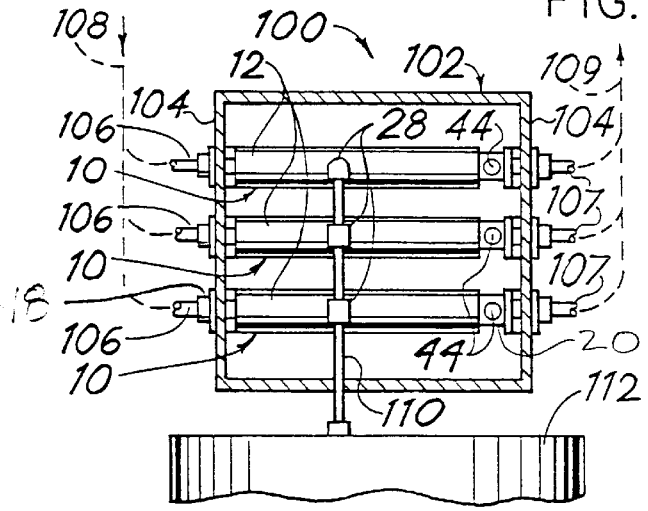
FIGS. 8 and 9 illustrate improved multiple ejector assemblies according to the invention.

Turning now to FIG. 8, there is illustrated a fluid jet ejector assembly 100 according to the invention including a plurality of individual fluid jet ejectors 10. Each ejector 10 is identical to the ejector illustrated in FIGS. 1–4. The several ejectors 10 are mounted in a frame or housing 102 including horizontally-spaced vertical walls 104. The ends of the ejector bodies 12 extend through and are fixed in any convenient way to the side walls 104. These side walls support the ejectors horizontally one over the other in the vertical stack-like arrangement illustrated. Connected to the primary fluid inlets 18 of the several ejectors are fluid supply lines 106 through which primary fluid under pressure is delivered Lo the ejectors. Connected to the ejector fluid outlets 20 are fluid discharge lines 107 through which fluid exits from the ejectors. If desired, the several fluid supply lines 106 may connect to a single common supply line 108, and the several discharge lines 107 may connect to a single common discharge line 109. The secondary fluid inlets 28 of the several ejectors are connected to a common secondary fluid inlet line 110. In FIG. 8, this inlet line connects to a tank 112 from which fluid is drawn into the individual ejectors 10 through the inlet line 110 during operation of the ejectors. While a single vertical stack of ejectors has been illustrated, the ejector assembly may include additional vertical ejector stacks arranged side by side. In this case, the secondary fluid inlets of all the ejectors may connect to the tank 112 through a common inlet line.

Figure 9:
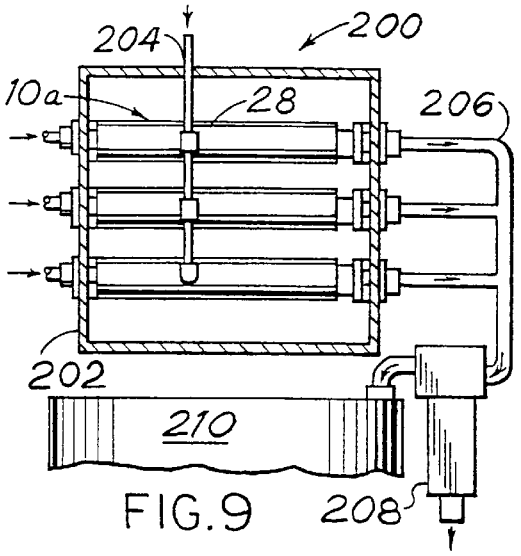

FIG. 9 illustrates a fluid jet ejector or compressor assembly 200 which is similar to the ejector assembly 100 of FIG. 8 and differs from the latter assembly only in the following respects. The individual fluid jet ejectors 10A of the assembly 200 are identical to the fluid jet ejector or compressor illustrated in FIG. 10. The several jet compressors 10A are mounted in a frame or housing 202 in a manner similar to the mounting of ejectors 10 in FIG. 8. The secondary fluid inlets 28 of the several jet compressors 10A are connected through a common secondary fluid inlet line 204 to a source of gas to be compressed. In FIG. 9, this gas is air, and the inlet line 204 opens to atmosphere, whereby air is drawn into the jet compressors 10A from the atmosphere. The jet compressors are connected via a common fluid line 206 to a conventional air/water separator 208, the pressurized air or gas output of which is conducted via a conduit to a pressure storage vessel 210.

In the ejector and compressor assemblies of FIGS. 8 and 9, the several fluid jet ejectors 10 and fluid jet compressors 10A are effectively arranged in parallel and their fluid pumping actions are additive. The assemblies may include as many ejectors/compressors as necessary, for example, up to one hundred or more, to achieve a desired pumping volume.

The modular fluid jet ejector 300 illustrated in FIGS. 11–16 has a modular, generally rectangular block-like body 302 composed of four separately formed parts 304, 306, 308, 310 disposed side by side with their opposing faces in contact. These parts may be machined or cast parts. The several parts are rigidly joined by bolts 312 and sealed to one another by seal rings 314 between the parts. The two outer parts 304 and 306 have the shape of rectangular plates. Part 308 has a flat rectangular block shape. Part 310 has a generally cubic shape. Outer part 304 has a threaded primary inlet 316 connected to a primary fluid inlet line 318. Outer part 306 has a threaded outlet 320 coaxial with the inlet 316 and connected to a fluid outlet line 322.

Figure 16:
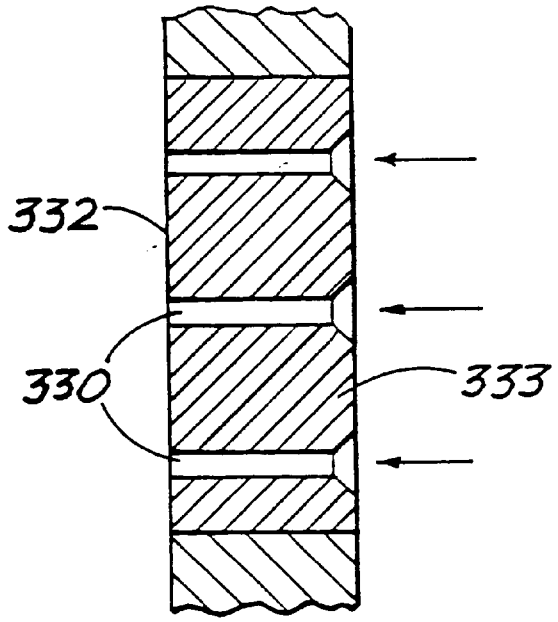
FIG. 16 is an enlarged section taken in line 16—16 in FIG. 14.

Entering the right and left sides (as viewed in FIG. 12) of the part 308 are recesses 324 and 326 coaxially aligned with the inlet and outlet 316 and 320 and having the generally rectangular shape illustrated in FIG. 13. Recesses 324 and 326 form a fluid inlet chamber and a vacuum chamber, respectively, separated by a relatively thin wall 328. This wall contains a multiplicity of small holes 330 which form orifice-like jets. As shown best in FIGS. 13 and 14, the jets 330 are arranged in several groups 332 each containing a plurality of jets. The jets 330 in each group are preferably seven in number, as illustrated, and arranged in the same way as described earlier in connection with FIGS. 1–4. The jet groups 332 are spaced about the wall 328. Preferably, each group of jets is contained in an insert 333 which is fixed within an opening in the wall 328. The inlet ends of the jets 330 are preferably beveled, as shown in FIG. 16. The depth of the bevel is preferably on the order of $^{70}/_{1000}$ inches and diameter of the jets is preferably on the order of $^{80}/_{1000}$ inches.

Entering the left side of the part 310 is a recess 334 aligned with and having the same rectangular shape and size as the vacuum chamber 326. Recess 334 forms an outlet chamber. Extending through the part 310 between the vacuum chamber 326 and the outlet chamber 334 are a plurality of convergent-divergent diffusers 336. These diffusers are equal in number to and coaxially aligned with the jet groups 332, respectively. Part 310 has a secondary fluid inlet 338 opening to the vacuum chamber 326 and connected to a secondary fluid inlet line 340.

It is obvious from the foregoing description that the modular jet ejector 300 operates in essentially the same manner as the jet ejector 10 of FIGS. 1–4 during primary fluid flow through the ejector from the inlet line 318 to the outlet line 322. Each diffuser 336 is associated with a group 332 of jets 330. Each jet group directs jet streams of primary fluid through the vacuum chamber 326 into the associated diffuser. These jet streams define therebetween flow paths in which secondary fluid entering the inlet 340 is entrained and carried from the ejector with the primary fluid in the same manner as described earlier in connection with FIGS. 1–4. A novel advantage of the modular jet ejector is that a number of the ejectors may be stacked one on the other in any number of vertical stacks arranged side by side to form a jet ejector assembly comprising any number of ejectors which may be interconnected like those in the assemblies of FIGS. 8 and 9 to provide a high pumping volume ejector assembly.

It will be understood that a modular jet ejector assembly 300 of FIGS. 11 and 12 is adaptable for use as a compressor by utilizing jet compressors according to FIG. 10, hereinbefore described, with the output of the compressors passing through a common outlet line to a conventional air/water separator (not shown) from which the compressed air or other gas is discharged under pressure via a conduit to a pressure storage vessel.

Figure 17:
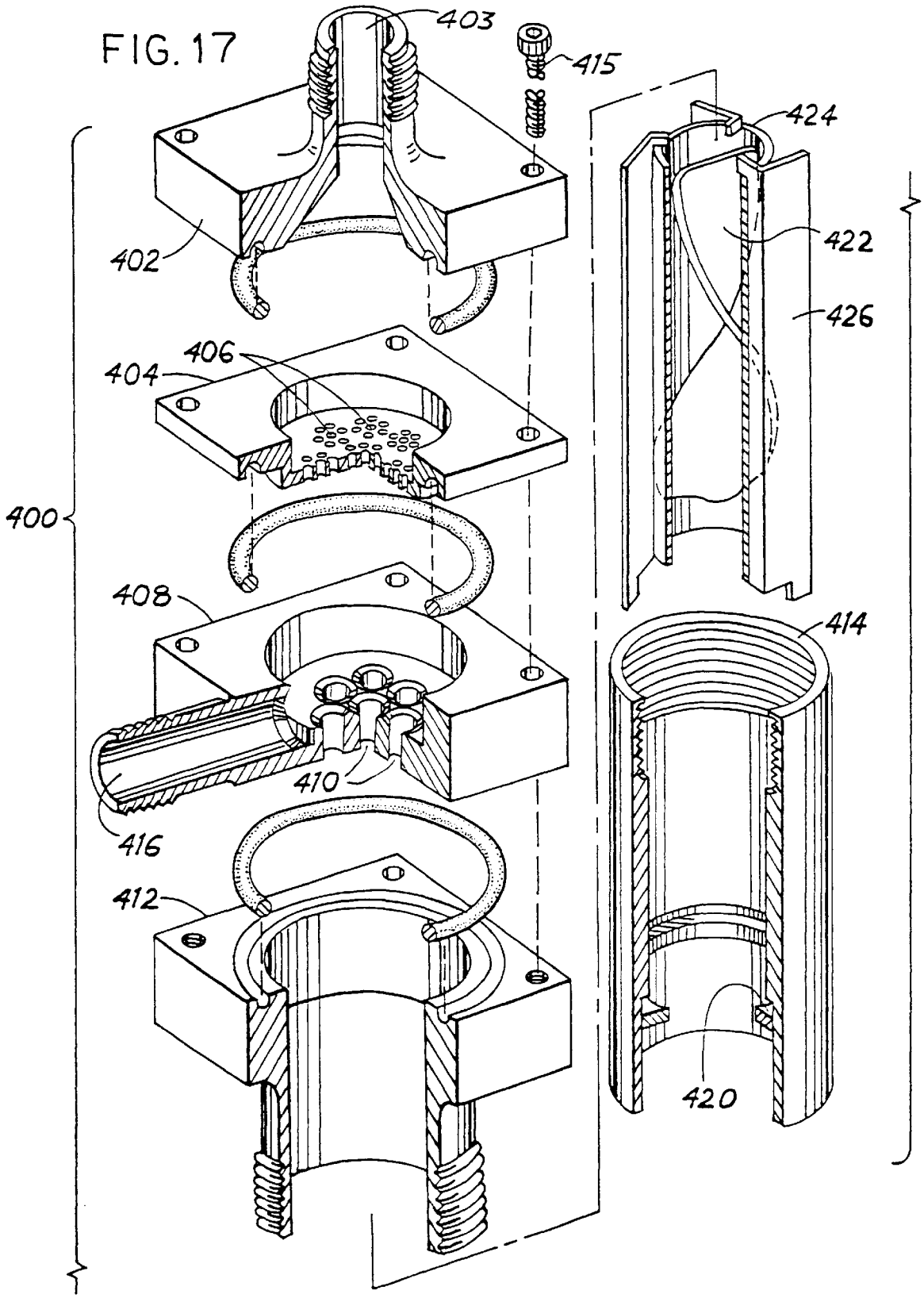
FIG. 17 is an exploded perspective view of another embodiment of the invention which embodies features for improving efficiency by introducing added primary fluid adjacent the nozzle exits.
Figure 18:
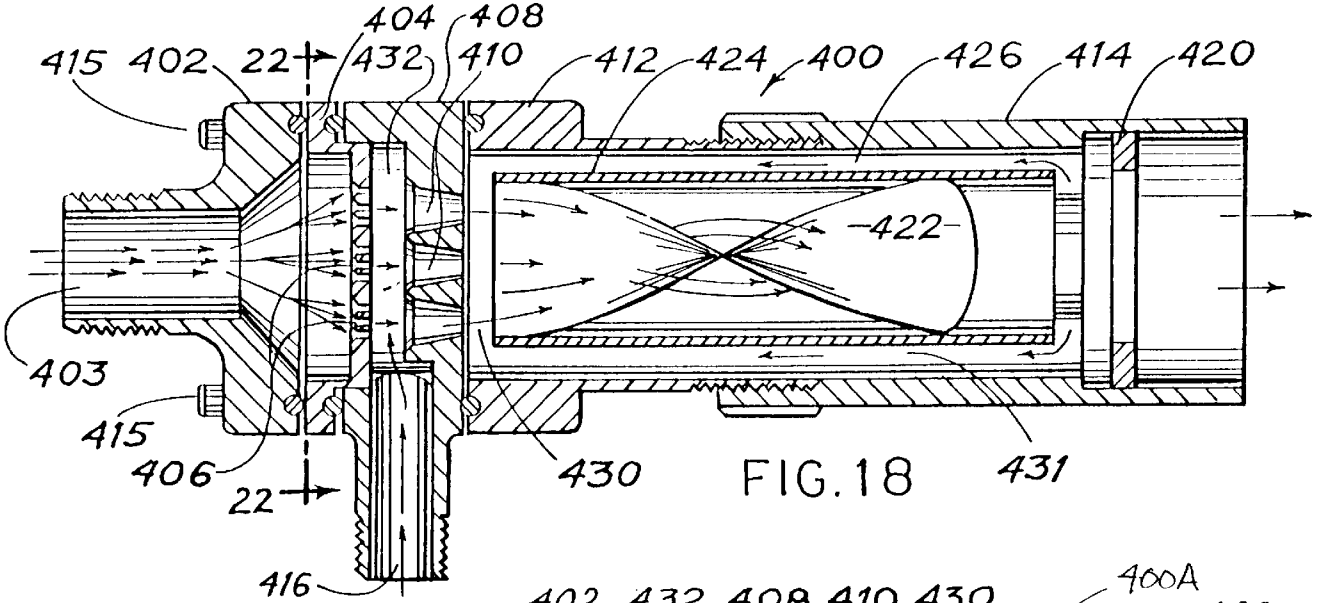
FIG. 18 is an e evational sectional view of the jet ejector in FIG. 17.
Figure 19:
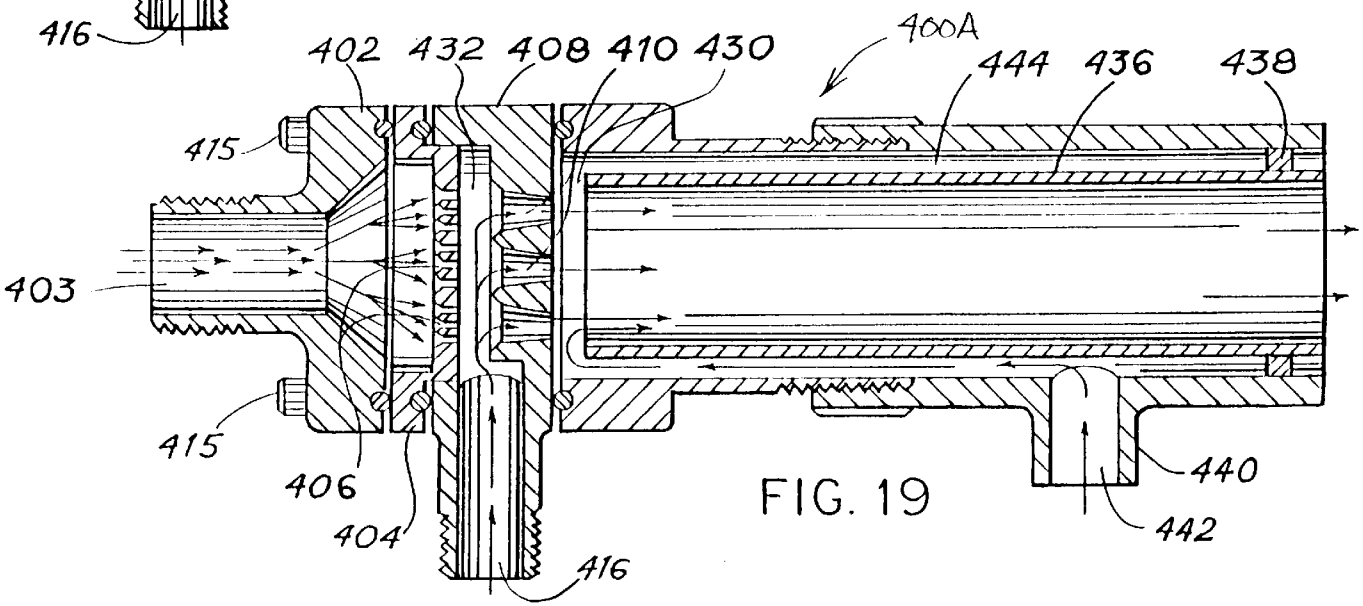
FIG. 19 is a sectional view similar to that of FIG. 18, showing a further embodiment for the introduction of added primary fluid adjacent the nozzle exits.

FIGS. 17 to 19 illustrate embodiments of the invention which provide greatly improved efficiency and performance by substantially reducing or eliminating the presence of secondary fluid or air at the output sides of the nozzles.

The fluid jet ejector 400 of FIGS. 17 and 18 comprises an inlet member 402 which defines an inlet 403 for a primary fluid, such as water, a generally cup-shaped orifice member 404 which defines a plurality of orifices or jets 406 similar to those of the earlier-described embodiments of the invention, a central member 408 wherein are defined a plurality of nozzles or diffusers 410 like those of the earlier-described embodiments, an outlet housing member 412, and a housing extension member 414 threadedly secured to member 412, as shown. FIGS. 22–24 show a preferred form of the orifices or jets 406, and FIG. 23 illustrates the geometric arrangement of a preferred form of jets 406. The members 402, 404, 408 and 412 are secured together by an elongated threaded fastener or tie rod 415 which extends through the members and is threadedly secured in member 412. Member 408 has an inlet passage 416 for passage of a secondary fluid, such as air.

A tubular fluid passage 431 is defined between exhaust tube 424 and coaxial housing members 412 and 414. Secured in member 414 is an annular diverter 420 which extends radially inwardly, as shown.

A spiral member 422 is mounted within an exhaust tube 424, as by welding, and has a twist of one hundred eighty degrees or more. Exhaust tube 424 is positioned relative to the housing members 412 and 414 by spacer elements 426 (FIG. 17). Exhaust tube 424 has its upstream end spaced from member 408 and the outlets of nozzles 410, thus to define a flow space 430.

In the operation of the device 400 of FIGS. 17 and 18, convergent orifices 406 produce jet streams like those of the earlier-described embodiments. The fluid, typically water, is discharged at high velocity through chamber 432 and toward the compression nozzles 410, as indicated in FIG. 4 of an earlier-described embodiment. The discharge is at high velocity through vacuum chamber 432 into the convergent nozzles 410. The fluid exits the ejector via exhaust tube 424. As with the earlier embodiments, acceleration of the primary fluid through the vacuum chamber 432 creates local reduced pressure in this chamber, which induces flow of secondary fluid, such as air, into the chamber via secondary fluid inlet 416. The entering secondary fluid is entrained by the high velocity primary fluid, typically water, passes through the vacuum chamber, and is carried with the primary fluid from the chamber through the converging nozzles 410. During passage of the combined fluid through the convergent nozzles, the fluid is compressed. As earlier described, the ejector may be operated with both liquid and gaseous fluids, such as air, water and steam, and utilized for various purposes, such as a vacuum pump, a fluid mixing device, and a fluid compressor.

Secondary fluid entering the vacuum chamber 432 via the secondary fluid inlet 416, is entrained in the jet streams in the same general manner as with the earlier-described embodiments.

The mixed fluid exiting the nozzles 410 passes through flow space 430 and is given a spiral path and movement by the spiral member 422. The mixed fluid is thus centrifugally urged radially outwardly against the inner wall of exhaust tube 424. The fluid thus impelled toward the wall of tube 424 passes there along and impacts or engages diverter 420, whereupon a substantial portion thereof is reversed in directional flow and is impelled, as indicated by the arrows in FIG. 18, in the reverse direction via the tubular passage 431, while the jet streams of mostly secondary fluid (air) are exhausted and expelled from exhaust tube 424. The flow thus redirected passes to the flow space 430, thus filling this space with primary fluid, substantially eliminating any secondary fluid (air) and turbulence therein, and preventing secondary fluid (air) from being drawn via nozzles 410 back into the vacuum chamber 432. Such backflow to chamber 432 would increase the pressure and reduce partial vacuum, thereby substantially reducing the intake of secondary fluid via intake 416, and substantially reducing the efficiency and performance of the ejector device. The efficiency of the fluid ejector device is greatly increased by maintaining appropriate low pressure and partial vacuum in chamber 432 to effect "solid" water jets with entrained air, passing from the nozzles to the exhaust tube. With the improved and maintained partial vacuum in the vacuum chamber effected in the manner described, the intake at inlet 416 provides high efficiency production of partial vacuum for application to and use with other equipment (not shown). With the arrangement, partial vacuum is readily maintained of 29 inches of Hg below atmospheric pressure.

The embodiment of FIG. 19 is like that of FIGS. 17 and 18 with respect to a number of components and features, and like features bear like reference numerals. The ejector 400A of FIG. 19 differs in that no spiral member is provided within an exhaust tube 436, an annular closure member 438 is provided about the outer end portion of the exhaust tube 436, to close the annular passage 444, and an input 440 having a passage 442 is provided for input of primary fluid along a line 461 from a source or tank 462 (FIG. 20).

Referring to FIG. 19, the jets from nozzles 410 pass through the flow space 430 and exit via the exhaust tube 436. The partial vacuum produced in chamber 432 causes an inward flow of primary fluid, typically water, via inlet passage 442 and thence through the tubular passage 444 to the flow space 430, thus to insure that space 430 is filled with water to substantially eliminate any secondary fluid, typically air, or eddies t hereof in space 430. Such elimination greatly increases the efficiency of the ejector in maintaining low pressure in chamber 432 and providing continuous desired partial vacuum at the secondary inlet 442 Efficiency and performance are greatly improved.

Referring to FIG. 20, there is illustrated a fluid jet ejector assembly 450 according to the invention including a plurality of individual fluid jet ejectors 400A. Each ejector is identical to the ejector 400A illustrated in FIG. 19. The several ejectors are mounted in a frame or housing. Connected to the primary fluid inlets of the several ejectors are fluid supply lines 452 through which primary fluid under pressure is delivered to the ejectors 400A. Connected to the ejector fluid outlets are fluid discharge lines 454 through which fluid exit s from the ejectors. If desired, the several fluid supply lines may connect to a single common supply line 456, and the several discharge lines 454 may connect to a single common discharge line 458. The secondary fluid inlets 416 of the several ejectors are connected to a common secondary fluid inlet line 460. In FIG. 20, primary fluid inlet line 461 connects to a tank 462 from which fluid is drawn into the individual ejectors 400A through the inlet line 461 during operation of the ejectors. While a single vertical stack of ejectors 400A has been illustrated, the ejector assembly 450 may include additional vertical ejector stacks arranged side by side.

FIG. 21 illustrates a fluid jet ejector or compressor assembly 470 which is similar to the ejector assembly 450 of FIG. 20 and differs from the latter assembly in the following respects. The individual fluid jet ejectors 400 of the assembly 470 are identical to the fluid jet ejectors of FIGS. 17 and 18. The several jet compressors 400 are mounted in a frame or housing in a manner similar to the mounting of ejectors in FIG. 9. The secondary fluid inlets 471 of the several jet compressors 400 are connected through a common secondary fluid inlet line 472 to a source of gas to be compressed. In FIG. 21, this gas is air, and the inlet line 472 opens to the atmosphere, whereby air is drawn into the jet compressors 400 from the atmosphere. Hence, secondary fluid inlets 471 admit atmospheric air. The jet compressors 400 are connected via a common fluid outlet line 474 to a conventional air/water separator 476, the pressurized air or gas output of which is conducted via a conduit to a pressure storage vessel 478.

Figure 25:
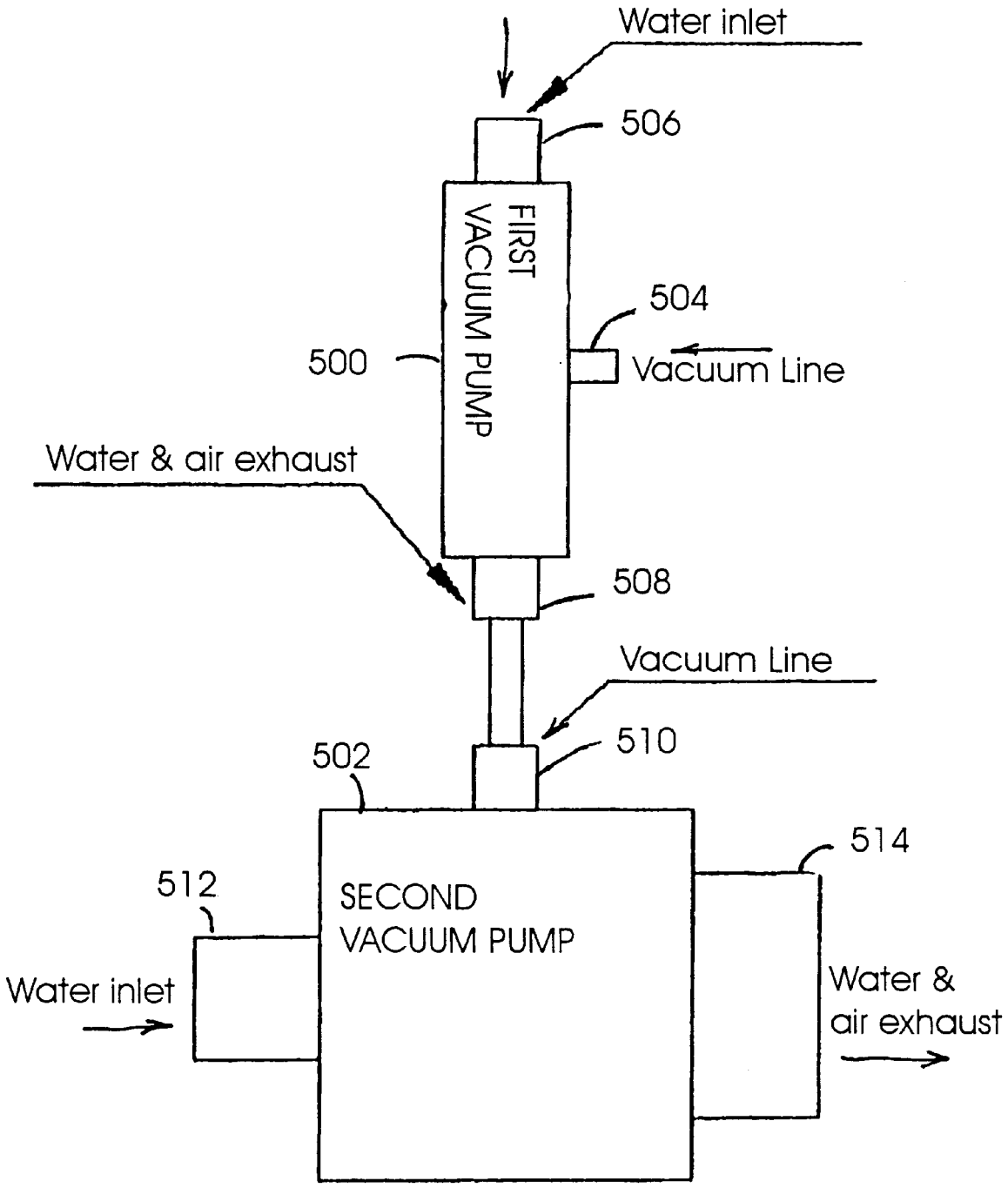
FIG. 25 is a Schematic side view of two fluid ejectors operated in series to effectuate a greater vacuum than a single fluid jet ejector.

FIG. 25 shows how to serially interconnect a first fluid jet ejector or pump 500 to a second larger fluid jet ejector or pump 502 to increase the amount of vacuum at a vacuum line 504 of ejector 500. The first fluid jet ejector 500 is connected as described above with a source of primary fluid connected to a water inlet 506, and a source of secondary fluid connected to the vacuum line 504. A combined primary and secondary fluid exhaust 508 of ejector 500 is connected to a vacuum line 510 of ejector 502. A source of primary fluid is then connected to a fluid inlet 512 of ejector 502. The series system of ejectors 500 and 502 has a combined fluid exhaust 514. By connecting the exhaust 508 of ejector 500 to the secondary fluid inlet 510 of ejector 502, the vacuum force at the first ejector vacuum line 504 is increased. Note that the size of the second ejector 502 should be large enough to handle the first ejector exhaust 508 as an input to the second ejector vacuum line 510.

Figure 27:
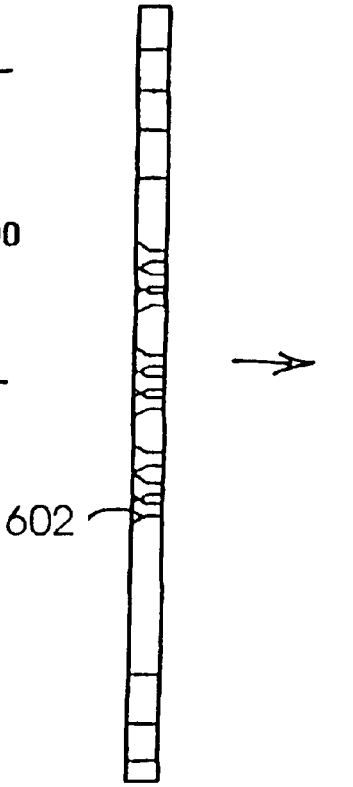
FIG. 27 is a side view of the orifice member of FIG. 26.
Figure 26:
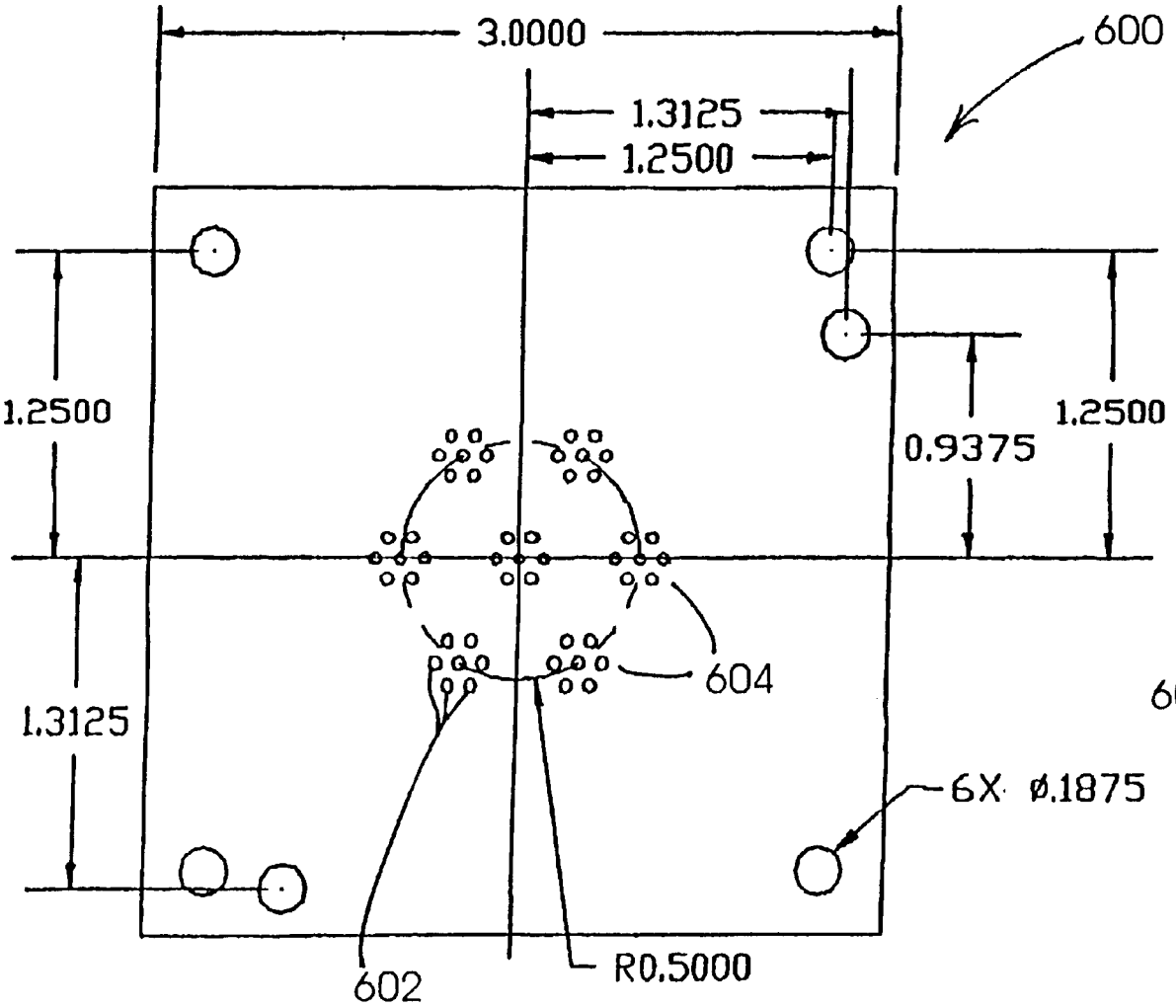
FIG. 26 is a schematic end view of a different embodiment of the orifice member in a planar configuration designed for industrial applications.

FIGS. 26 and 27 show a different embodiment of a high pressure planar jet plate orifice member 600 with high pressure jets 602 for an industrial vacuum pump or vacuum body. In this embodiment, the manufacture of the jet plate orifice member 600 is greatly simplified due to the absence of a depressed area requiring additional machining. The jets 602 are arranged in groups 604 similar to the groups of jets 406 of ejector 400 of FIGS. 17–19 and the groups 332 of jets 330 of modular ejector 300 of FIGS. 11–16. The jet plate 600 is adapted for use in a modular ejector such as ejectors 300, 400 or 400A.

Figure 29:
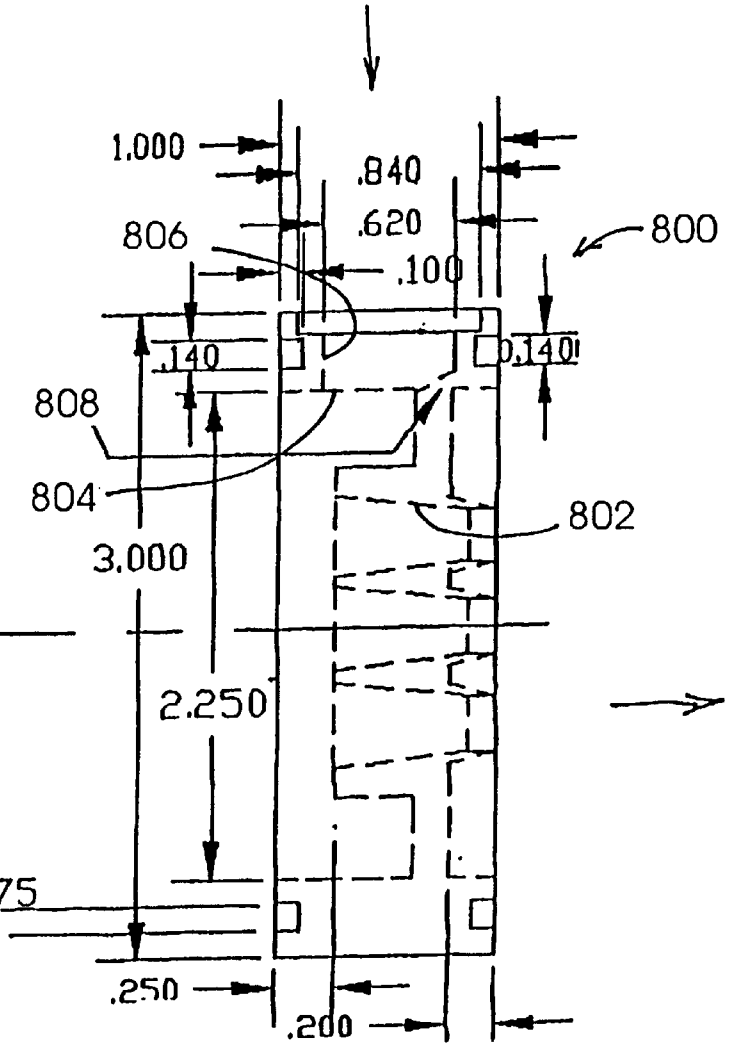
FIG. 29 is a side view of the modified central member for industrial use, as shown in FIG. 28, showing the extension of the diffuser nozzles.
Figure 28:
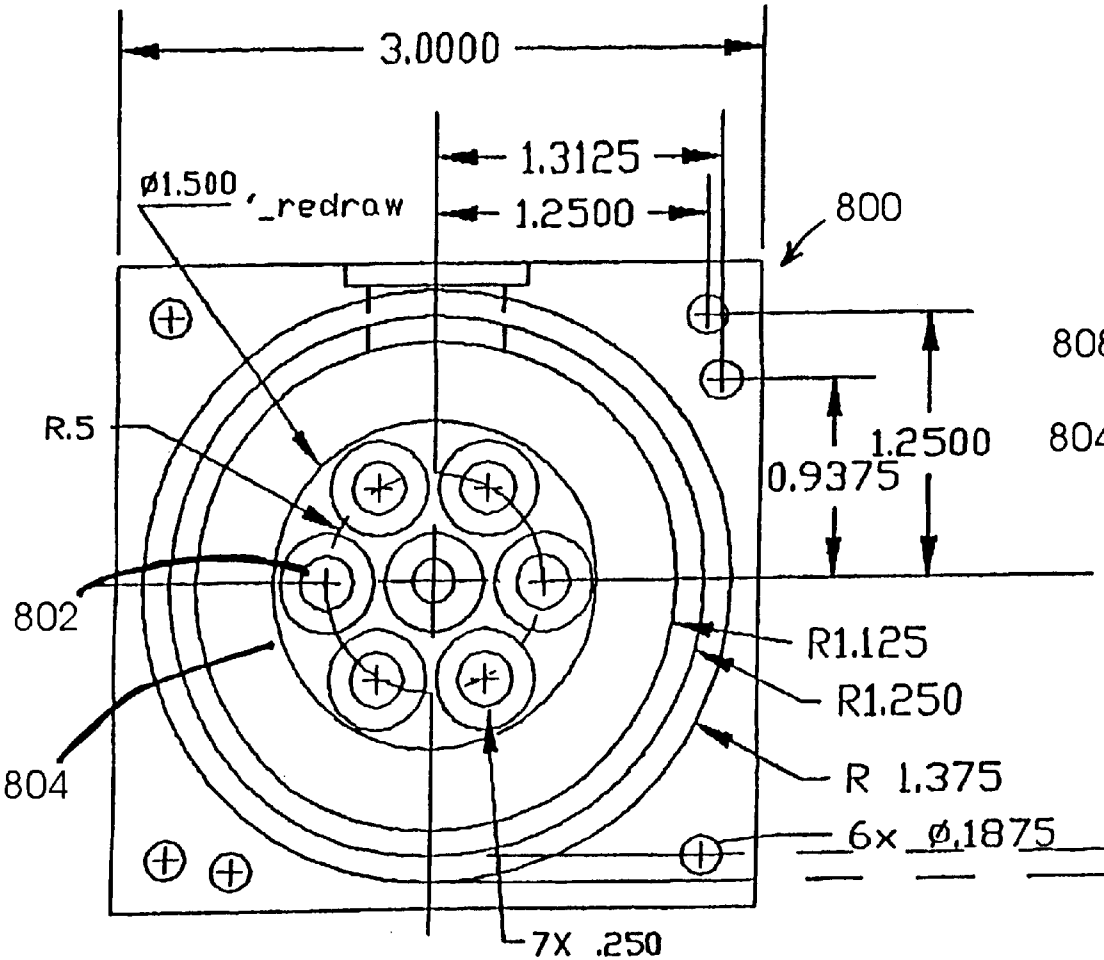
FIG. 28 is a schematic end view of a modified central member for industrial use.

FIGS. 28–29 show an alternative modified central member 800 with compression nozzles or diffusers 802 for an industrial vacuum pump or vacuum body. This modified central member 800 shows a preferred nozzle or diffuser configuration for a parallel ejector arrangement. The central member 800 is similar to the central member 408 of ejectors 400 and 400A of FIGS. 17–19. Central member 800 is adapted to be used with jet plate 600 of FIGS. 26 and 27 to form a modular ejector similar to the ejectors 300, 400 or 400A described above. The central member 800 includes a vacuum chamber 804 and a secondary fluid inlet 806. The entire modular ejector including plate 600 and member 800 can be made within a 3 inch cube and can move about 10 CFPM (cubic feet per minute) of air or pull 29.5 in. Hg. Such an industrial vacuum pump can also be set up in parallel with other modular ejectors so that it can move up to about 1000 CFPM of air.

Figure 30:
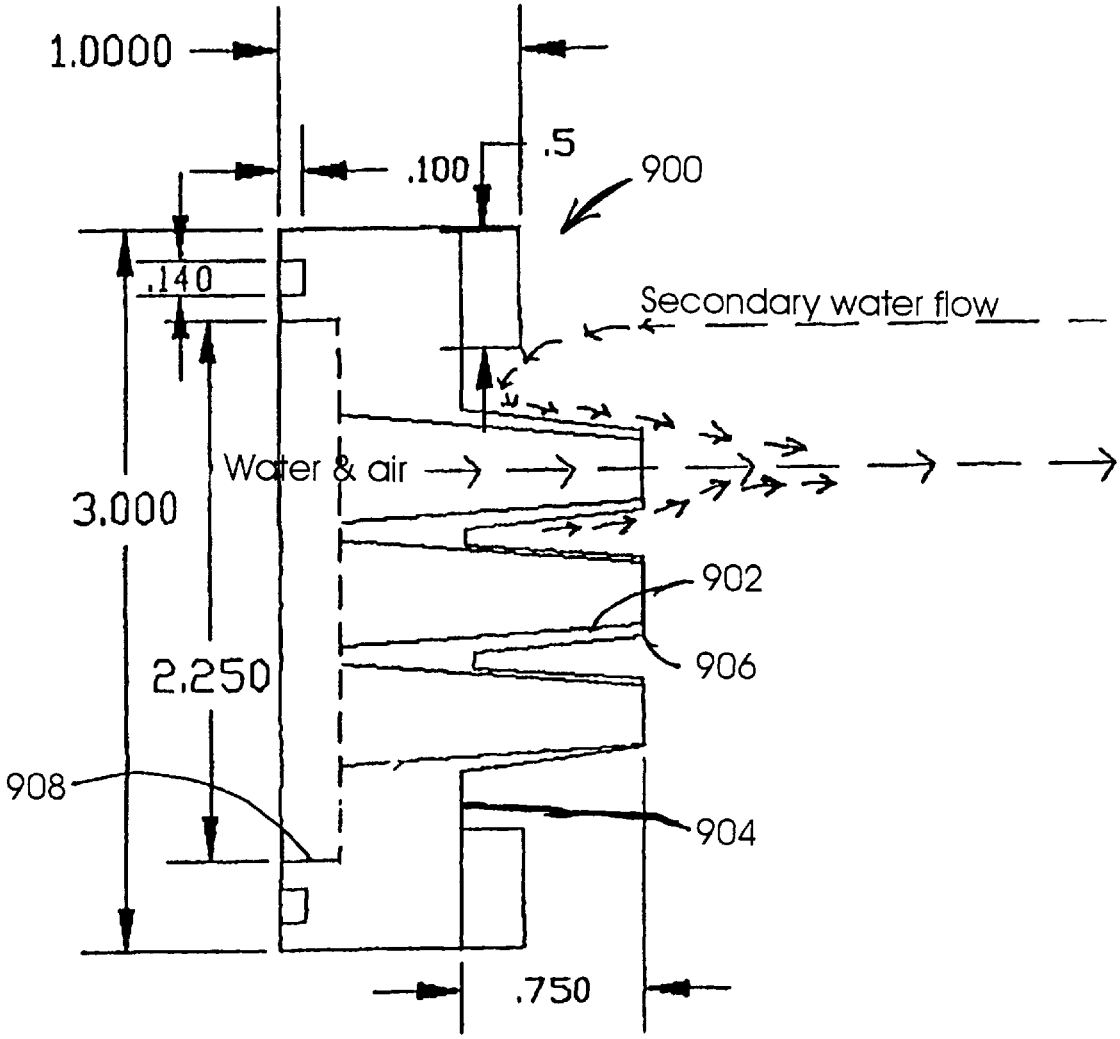
FIG. 30 is a side view of another embodiment of the modified central member of FIG. 28, showing an increase in the extension of the diffuser nozzles into the outlet chamber area.

FIG. 30 depicts an alternative central member 900 which is generally similar to the central member 800 of FIGS. 28 and 29. The member 900 has nozzles or diffusers 902 which extend past an end wall 904 to create a better secondary water flow over ends 906 of the nozzles 902, thus eliminating the backflow of the secondary fluid into a vacuum chamber 908.

As shown in at least FIGS. 31–41 and 44–61 and in accordance with an exemplary embodiment of the present invention, a small vacuum unit, home use type vacuum seal kit, vacuum system, or the like, is generally designated by the reference numeral 1010 and includes a vacuum body 1012 including a high pressure jet body or fluid jet insert 1014 therein, a back pressure pipe assembly or exhaust assembly 1016, a vacuum breaker or relief valve 1018, an elongate flexible vacuum hose 1020, a vacuum cap 1022, a valve piece or element 1024, and a lid 1026. The vacuum cap 1022, valve piece 1024 and lid 1026 together form a vacuum cap, valve piece and lid assembly 1028. It is preferred that the kit 1010 further include a ½ inch MPT to garden hose adapter 1030, a hose washer and strainer or filter 1032, and a flow control valve 1034 such as a plastic ball valve adapted to be attached to the male end 1036 of a garden hose 1038 or faucet.

Figure 31:
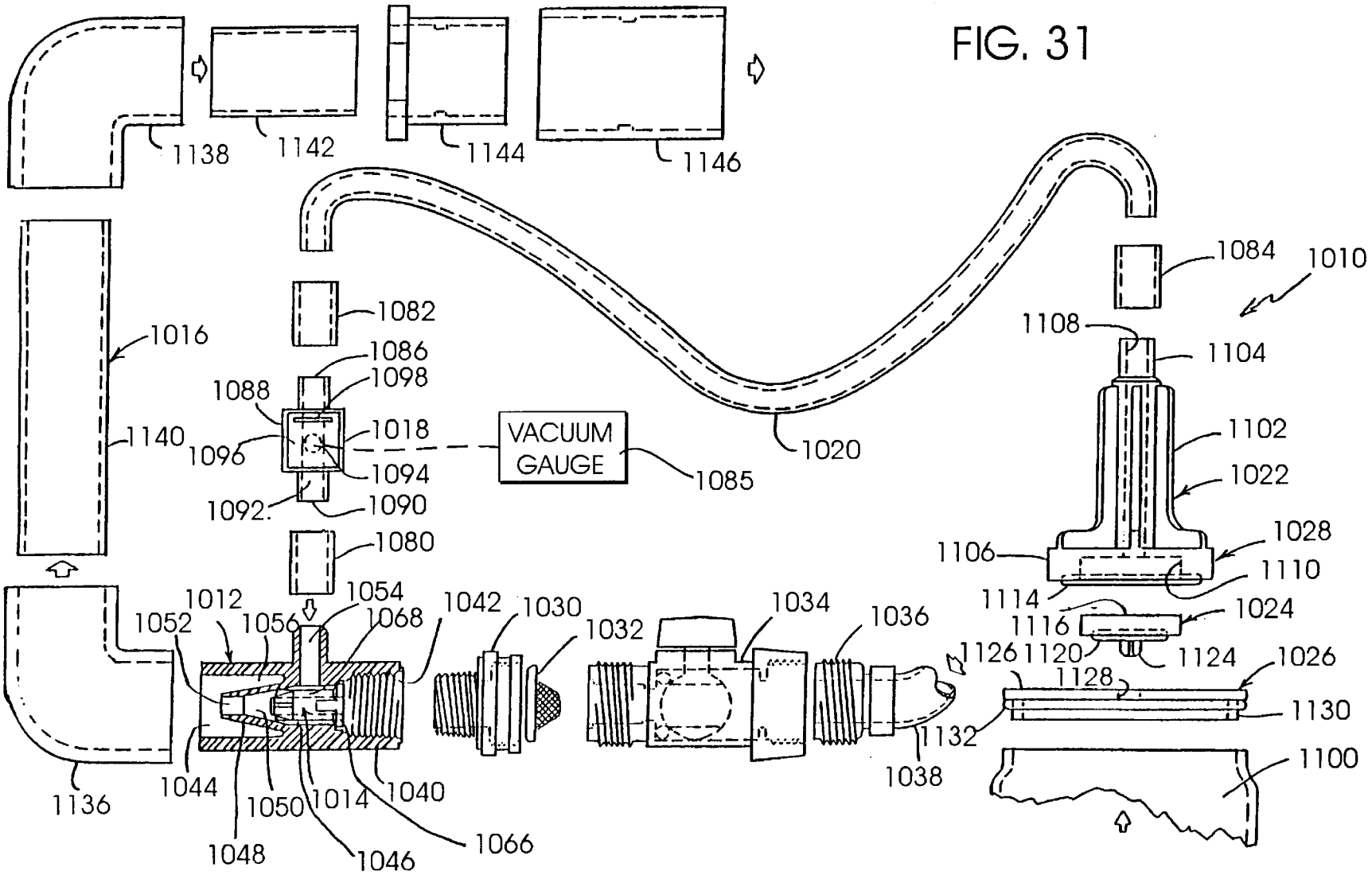
FIGS. 31–43, 60, 61, and 64 of the drawings show an exemplary embodiment of a jet ejector small vacuum unit in different configurations.
Figure 32:
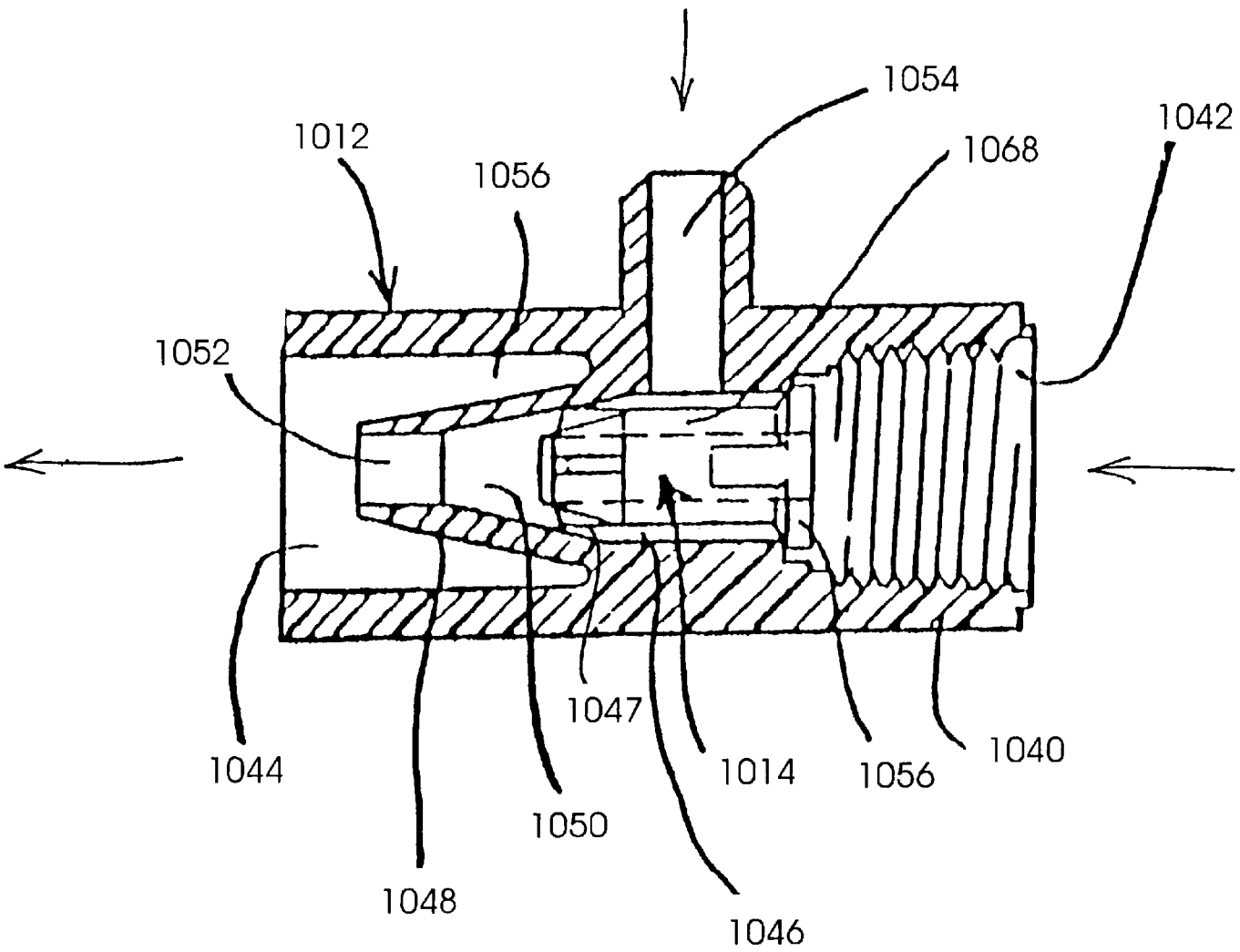

As shown in FIG. 31, flexible cylindrical connectors 1080, 1082 and 1084 join the vacuum breaker or relief valve 1018 to the secondary inlet 1054, the elongate vacuum hose 1020 to the relief valve 1018, and the cap 1022 to the elongate hose 1020, respectively. Preferably, the cylindrical connectors 1080, 1082 and 1084 are formed of short sections of a somewhat flexible or resilient tubing material which provides a releasable coupling between the respective components.

Figure 48:
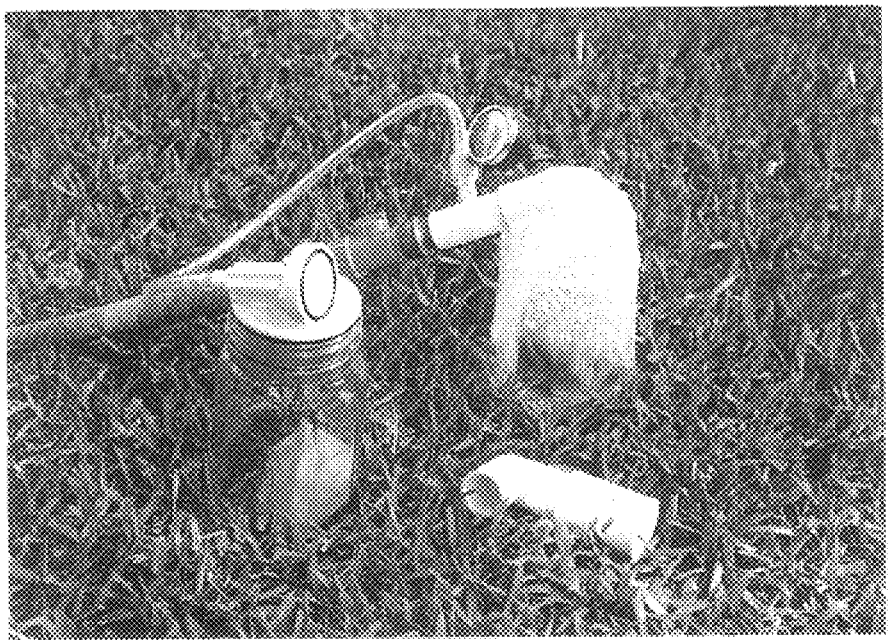
Figure 49:
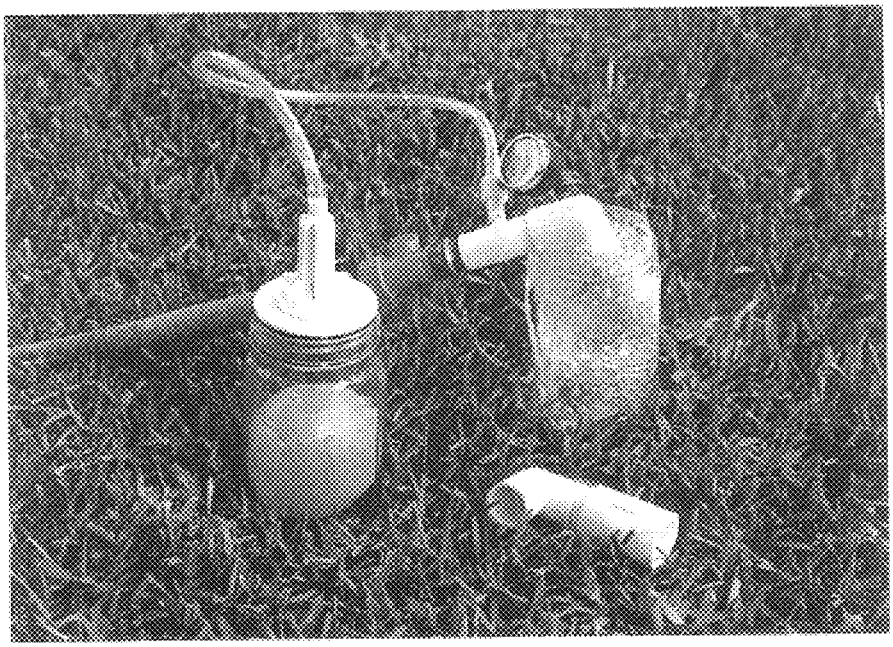

A vacuum gauge 1085 may be added to the vacuum breaker or relief valve 1018 so that the user can apply the vacuum kit or device to selected applications to create a selected vacuum or differing vacuums based on the different container, food, or use of the device (FIGS. 48 and 49). A vacuum gauge is not required since there are other indicators that full vacuum has been reached. For example, when the water exiting the exhaust or discharge assembly 1016 ceases to include bubbles, one knows that substantially complete vacuum has been reached in the Mason Jar 1100.

Elbows 1136 and 1138 of exhaust assembly 1016 tend to eliminate high velocity water exiting the vacuum body 1012 and thereby create sufficient back pressure to maximize the vacuum created by vacuum body 1012.

The vacuum breaker or relief valve 1018 includes a cylindrical upstream end 1086, an enlarged central portion 1088 and a cylindrical downstream end 1090. An axial fluid passage 1092 extends therethrough to provide fluid communication between the vacuum hose 1020 and secondary fluid inlet 1054. A transverse opening 1094 joins the axial passage 1092 and is covered by a flap 1096 joined to a flat side of the enlarged section 1088 along a hinge 1098. The fluid passage 1094 is opened to the outside air to break or release the vacuum in passage 1092 and hose 1020 by lifting flap 1096 and allowing air to enter passage 1094 and into passage 1092. During normal operation of the device and during evacuation of, for example, Mason Jar 1100, the flap 1096 is pulled tightly against the flat side of enlarged section 1088 and the outer edge of the passage 1094 to seal off the passage 1094.

The back pressure or exhaust assembly 1016 includes first and second elbows 1136 and 1138, first and second straight sections 1140 and 1142, an adapter or bushing 1144, and a coupling 1146. It is preferred to form the back pressure assembly 1016 of conventional PVC hardware adapted to be press fit together and allow pivotal or rotational movement of one element relative to the other for use in one of a plurality of operating arrangements. It is contemplated that the assembly 1016 could be replaced with a single unitary item such as a U-shaped, C-shaped, L-shaped, or straight section of pipe or tubing with or without baffles therein to provide the necessary back pressure to create the desired or maximum vacuum in vacuum body 1012. For example, it is contemplated that a 4 inch section of ¾ inch PVC pipe may be attached to outlet 1044 of vacuum body 1012 to provide approximately 2 lbs. per square inch (PSI) of back pressure and allow vacuum body 1012 to produce a maximum vacuum of about 29.5 inches of mercury (in. Hg.).

As shown in FIGS. 31–34, the vacuum body 1012 of the vacuum unit 1010 is a vacuum pump or fluid jet ejector with a cylindrical housing 1040 having an axial fluid passage including a primary fluid inlet 1042 for receiving a pressurized primary fluid, which may be a liquid such as water, a mixed fluid outlet 1044, a vacuum chamber 1046 which is defined by the inner wall of the cylindrical housing 1040 and the exterior wall of press fit fluid jet insert 1014, and a convergent diffuser 1048 having a convergent or conical section 1050 and a constant diameter section 1052 which empties into the outlet 1044. The vacuum body 1012 further includes secondary fluid inlet 1054 leading to the fluid passage of the vacuum body and more particularly leading to the vacuum chamber 1046 to allow a secondary fluid, which may be a gas such as air, to be drawn into the vacuum chamber around the high pressure jet insert 1014 and into the convergent diffuser 1048 due to the vacuum created by the passage of pressurized primary fluid through the primary fluid inlet 1042 into and through the high pressure jet insert 1014, the convergent diffuser 1048 and the outlet 1044. The diffuser 1048 is surrounded by an annular cavity 1056 which reduces the back flow of air from the outlet 1044 into the diffuser and vacuum chamber.

Figure 43:
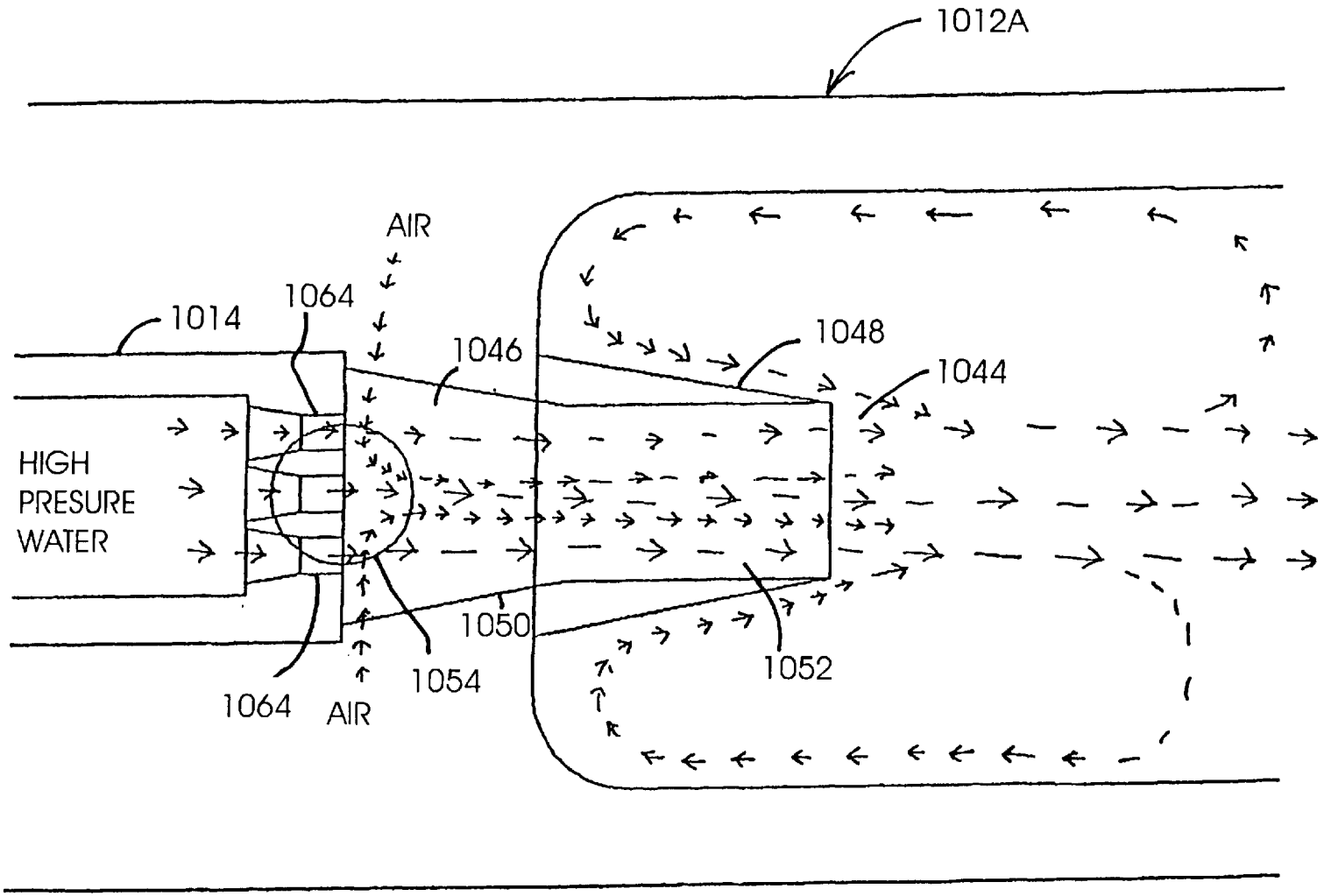
Figure 44:
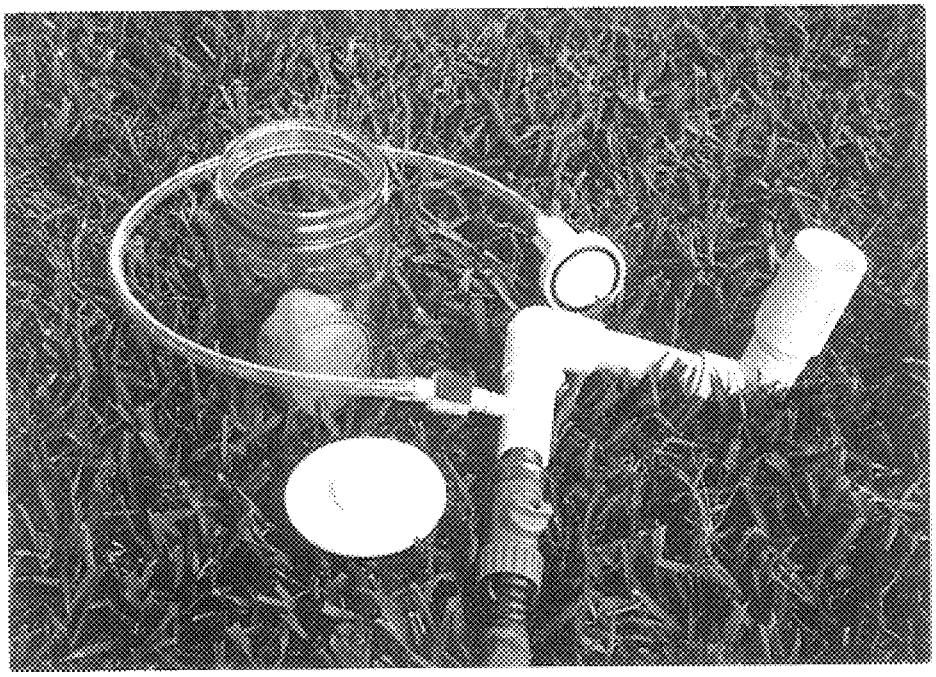
Figure 45:
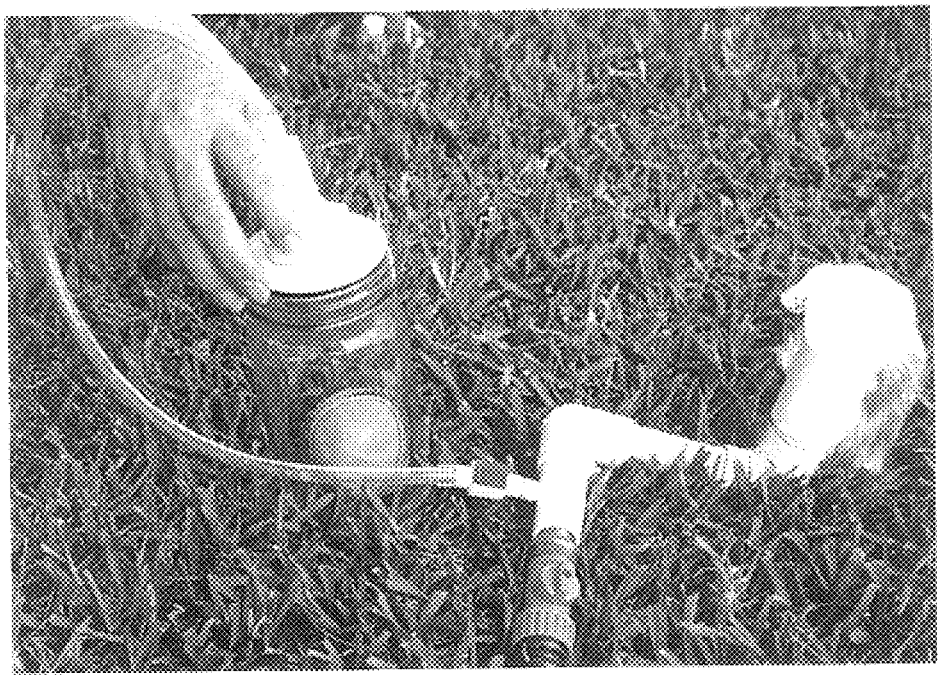
Figure 46:
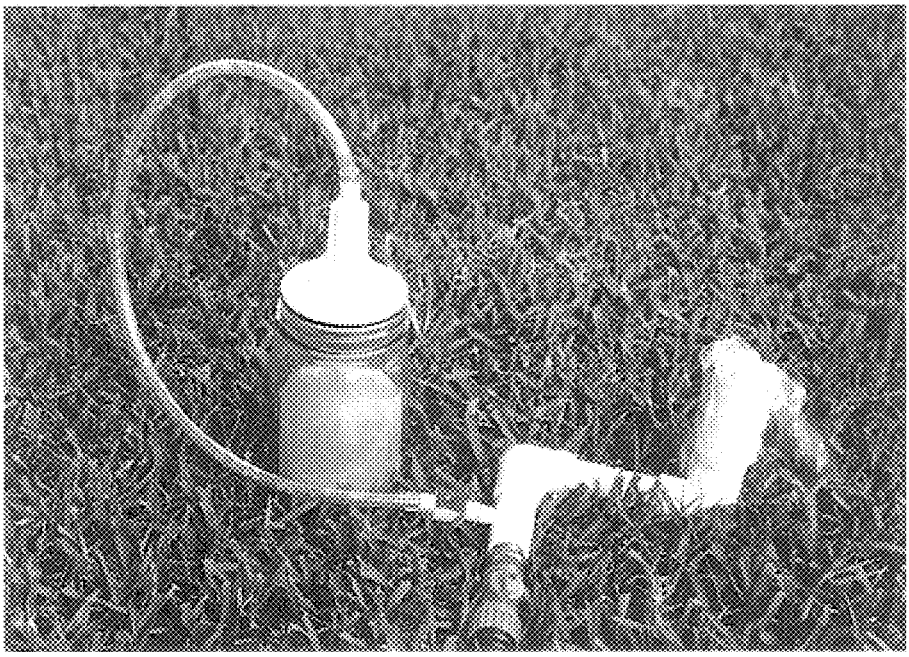
Figure 47:
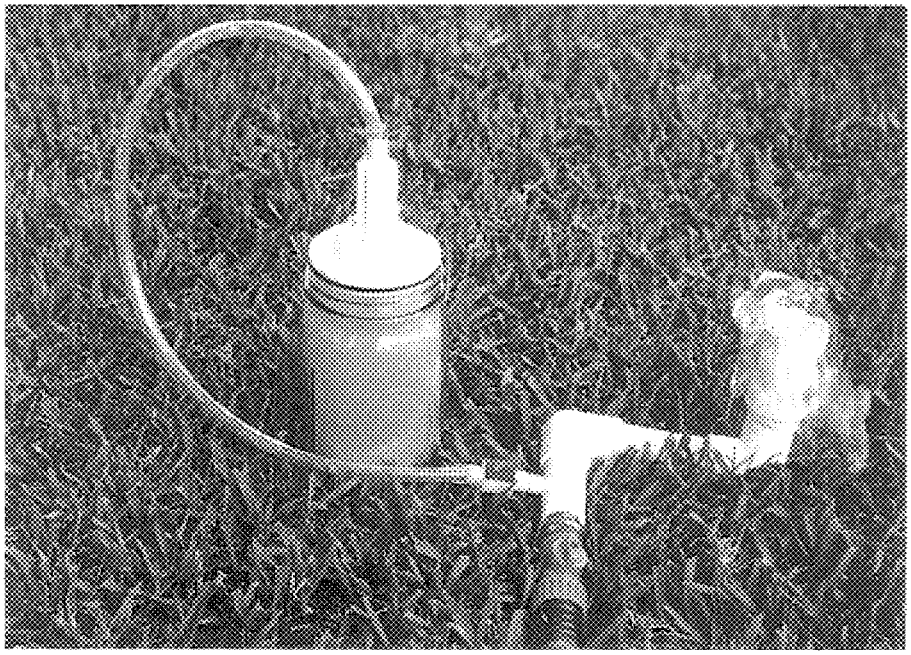

In accordance with the present invention, the vacuum produced by vacuum body 1012 and jet insert 1014 is maximized by eliminating the back flow of air into the primary and secondary fluid mixing area. The cavity 1056 surrounding the convergent diffuser 1048 allows water to flow back, in and around the diffuser and carry air away from the vacuum chamber and fluid mixing area. FIG. 43 is an illustration of this occurrence.

Figure 33:
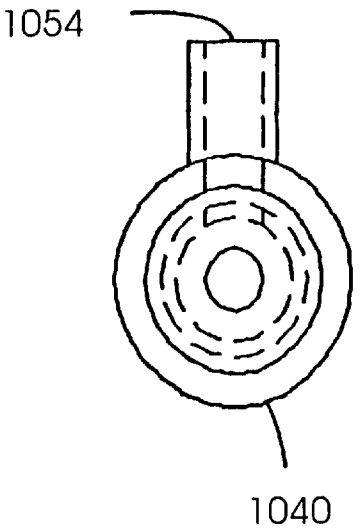

As shown in FIG. 33, the vacuum body 1012 is a cylindrical tube with a cylindrical flange extending therefrom for secondary fluid inlet 1054 and a central fluid passage with opening 1046 for insertion of the jet insert 1014.

Figure 34:
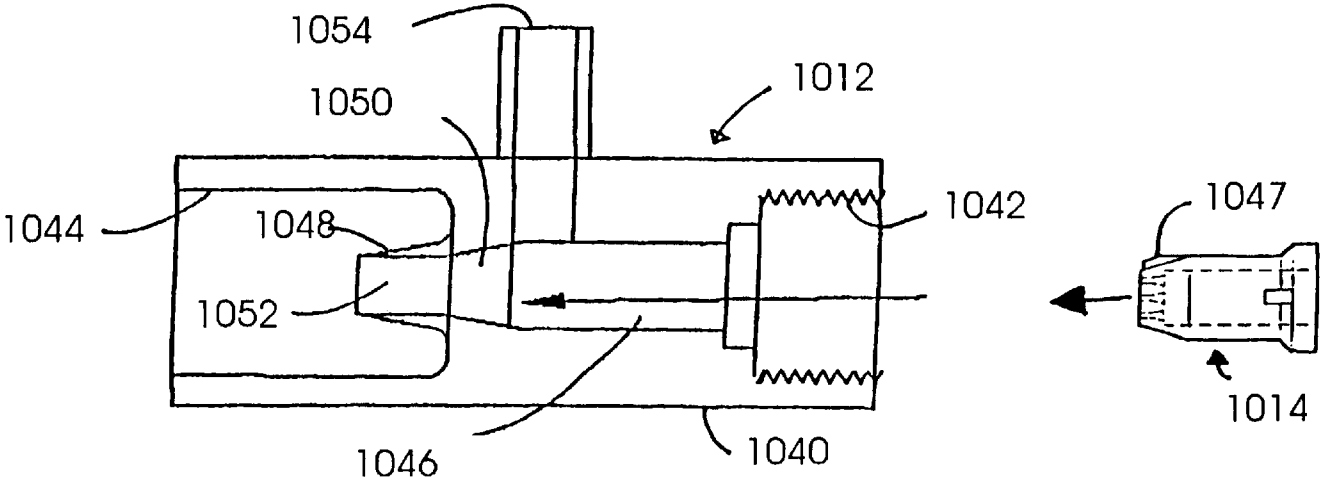

As shown in FIG. 34, the jet insert 1014 is installed by passing through fluid inlet 1042 into the vacuum chamber 1046 with tabs 1047 aligning the jet end of the insert 1014 with the conical walls of convergent section 1050 of diffuser 1048. The vacuum chamber 1046 is located between exterior wall 1068 of insert 1014 and the interior wall of the vacuum body 1012.

Figures 35, 36:
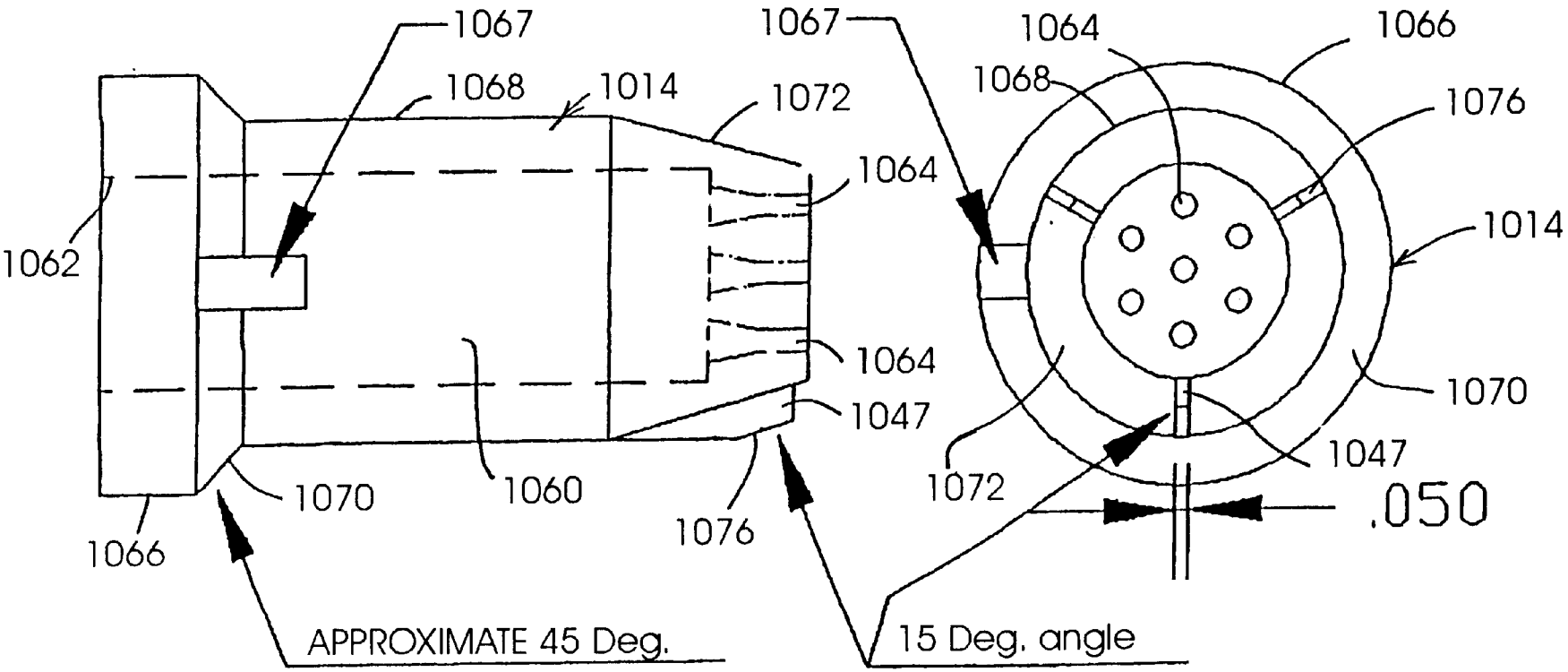

As shown in FIGS. 35 and 36, the high pressure jet insert 1014 includes a cylindrical fluid passage 1060 having a circular inlet 1062 and terminating in a plurality of small fluid jet openings 1064. At the inlet end of the insert 1014, a large diameter cylindrical flange 1066 is separated from an elongate cylindrical section 1068 by a short tapered section 1070. The taper section 1070 is adapted to form a press fit with the shoulder between the vacuum body inlet 1042 and the vacuum chamber 1046.

As seen in FIGS. 35–36, downstream of the cylindrical section 1068, the insert 1014 includes a tapered end 1072 with a plurality of alignment tabs 1047 extending radially outward therefrom. Each of the alignment tabs 1047 includes an angled surface 1076 adapted tc abut against the conical inner surface 1050 of the convergent diffuser 1048. The tabs 1047 and angled surfaces 1076 force the jets 1064 to the center of the diffuser and center the jet pattern axially to maximize the vacuum created by the vacuum body 1012 and insert 1014.

The vacuum body 1012 and insert 1014 are preferably formed of a sturdy rigid corrosion resistant material such as PVC, ABS plastic, HIPS plastic, or the like, the more preferential material is a HIPS plastic material. Although the vacuum body 1012 and insert 1014 are shown as;separate items which are formed separately and then press fit together, it is contemplated that given sophisticated molding and/or machining techniques, one could form the vacuum body and jet. insert as a single unitary molded item or as modular sectional components which are joined one to another in precise alignment.

Figure 37:
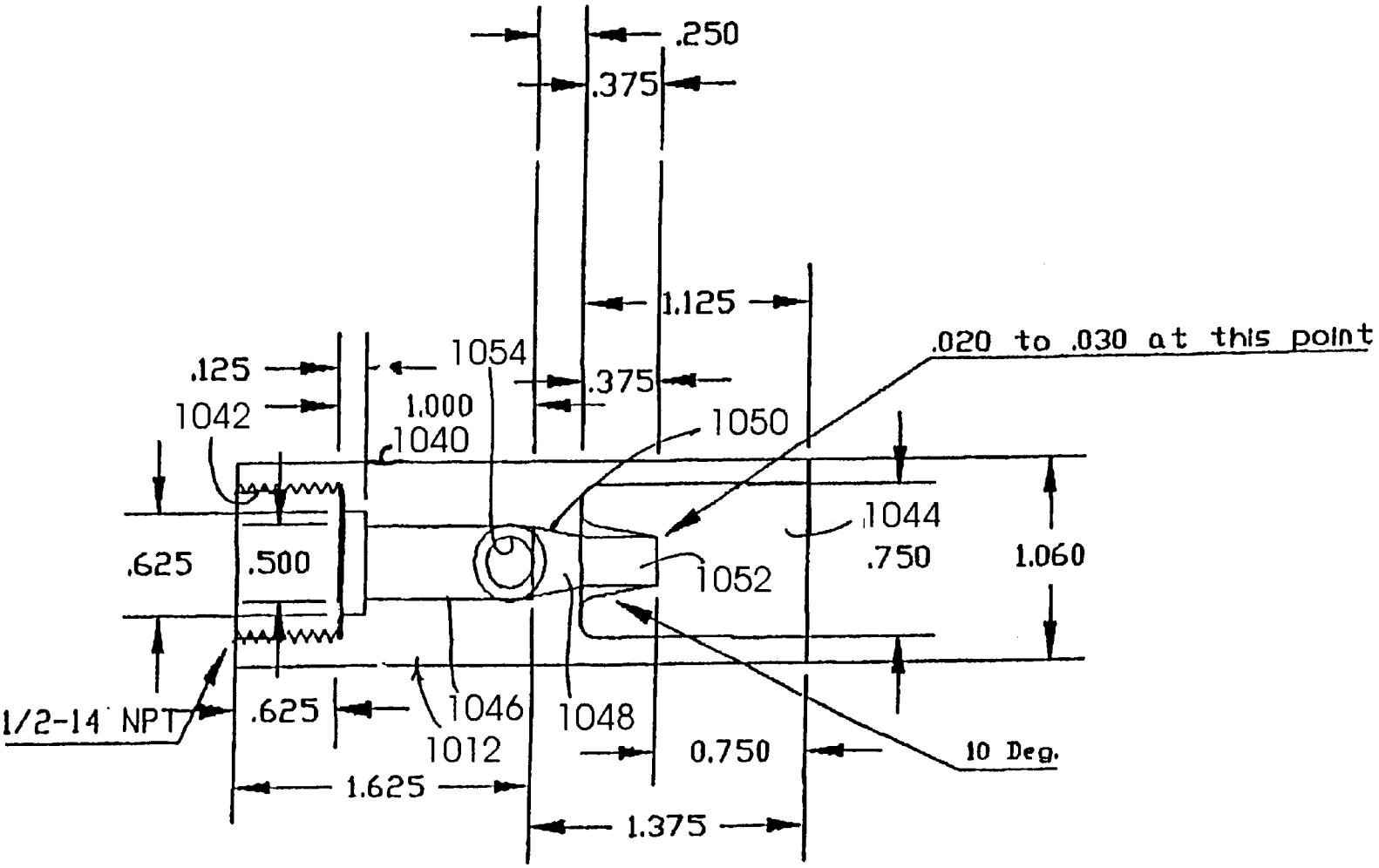
Figure 38:
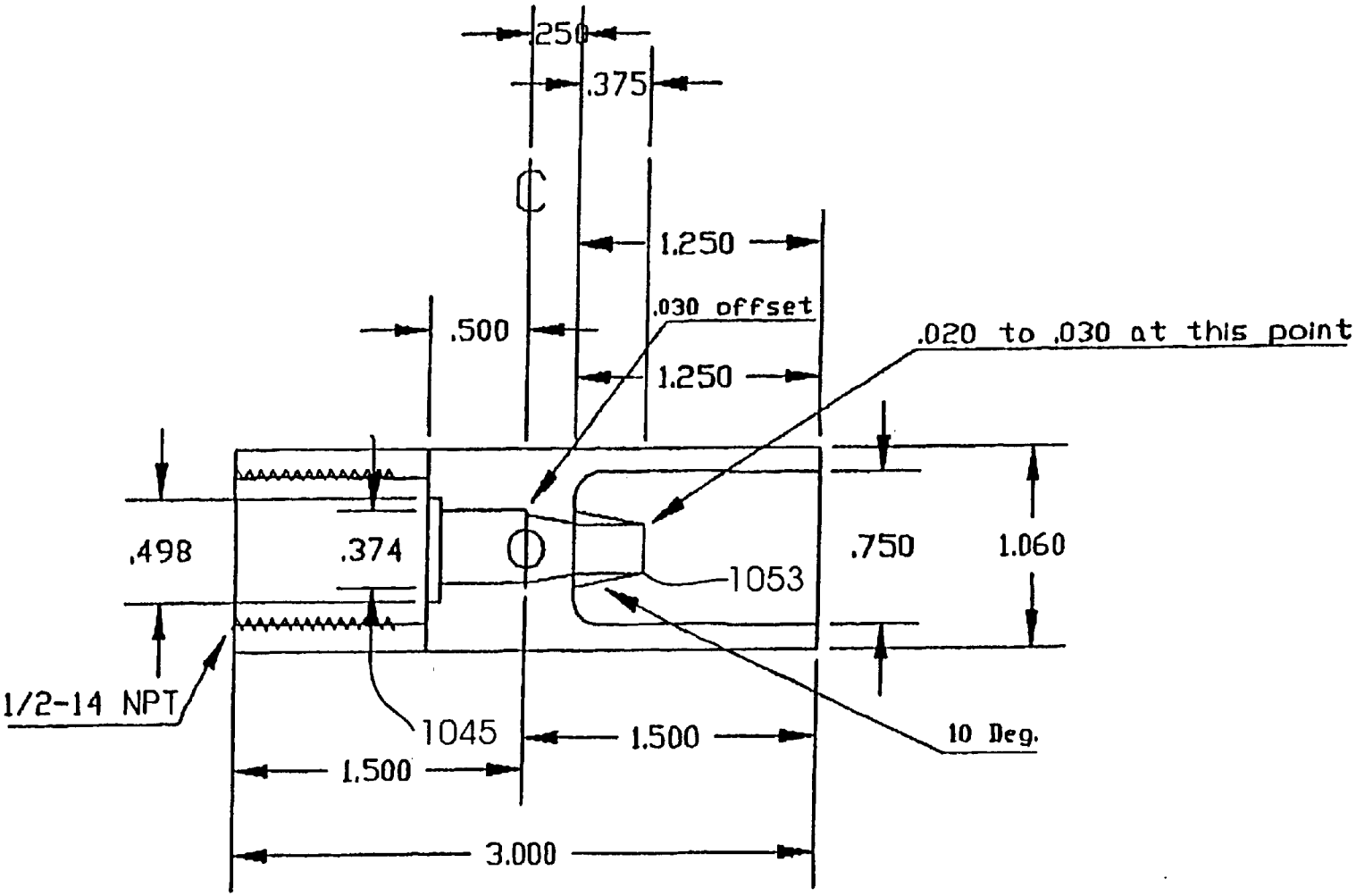

FIGS. 37 and 38 show detailed examples of the vacuum body 1012 of the small vacuum pump 1010 for use with a PVC piping system and the jet insert embodiment described herein.

Figure 39:
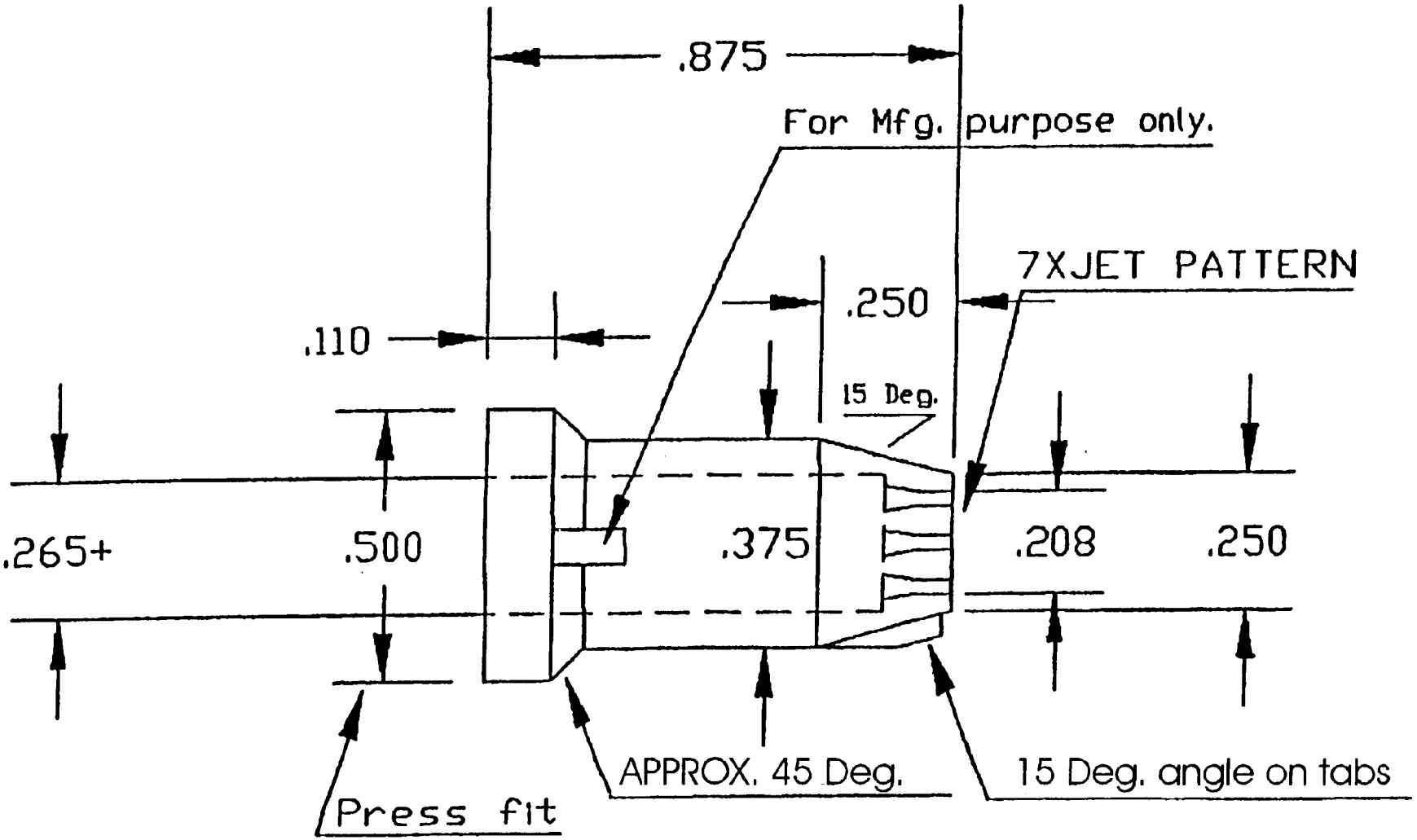
Figure 41:
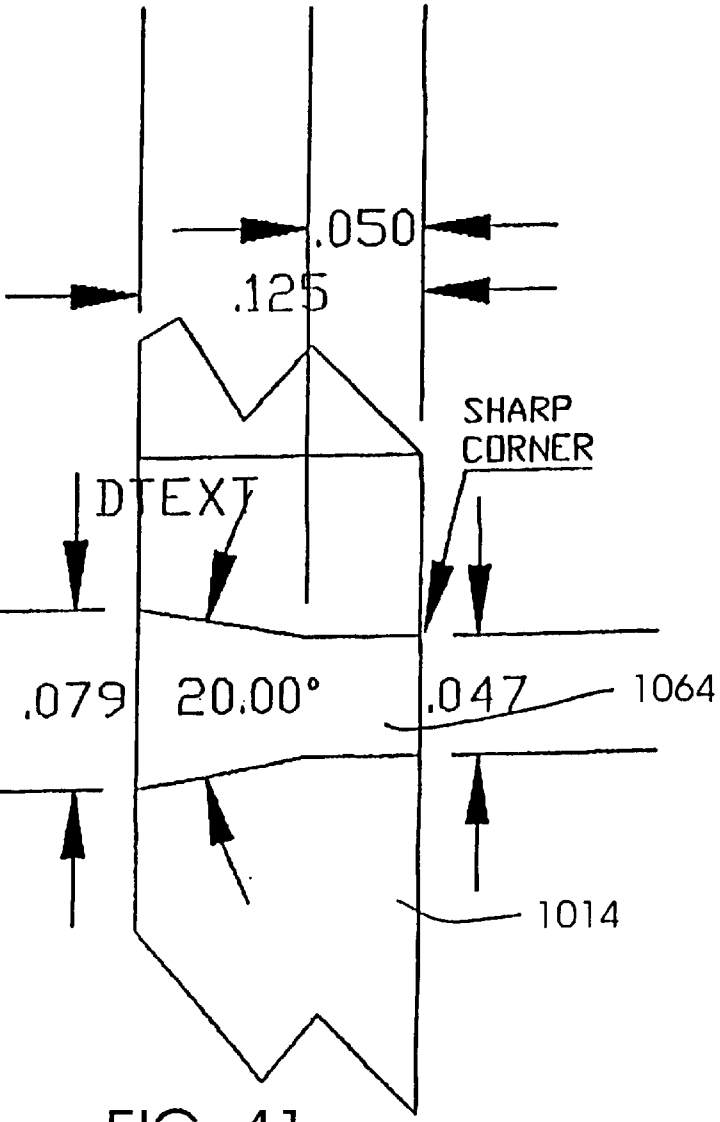
Figure 40:
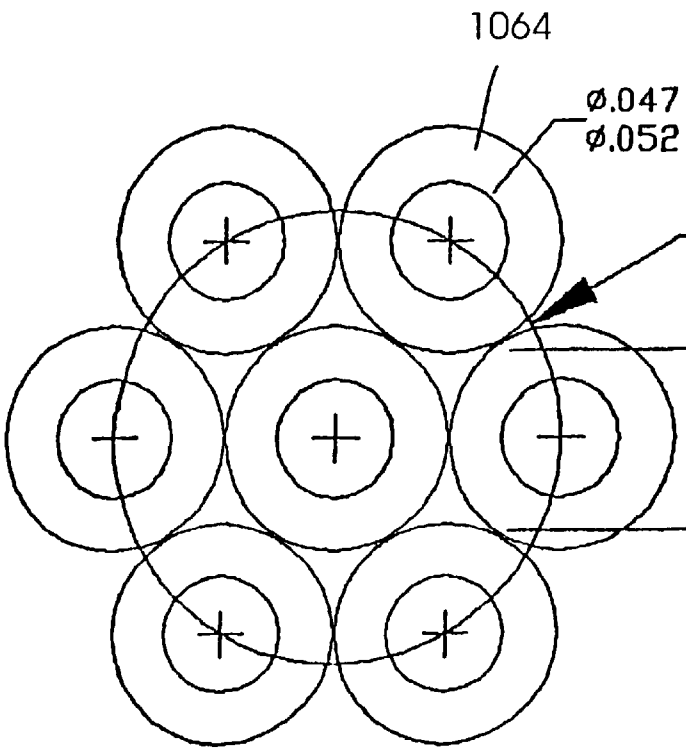

FIGS. 39–41 show a detailed example of the jet insert 1014.

Figure 42:
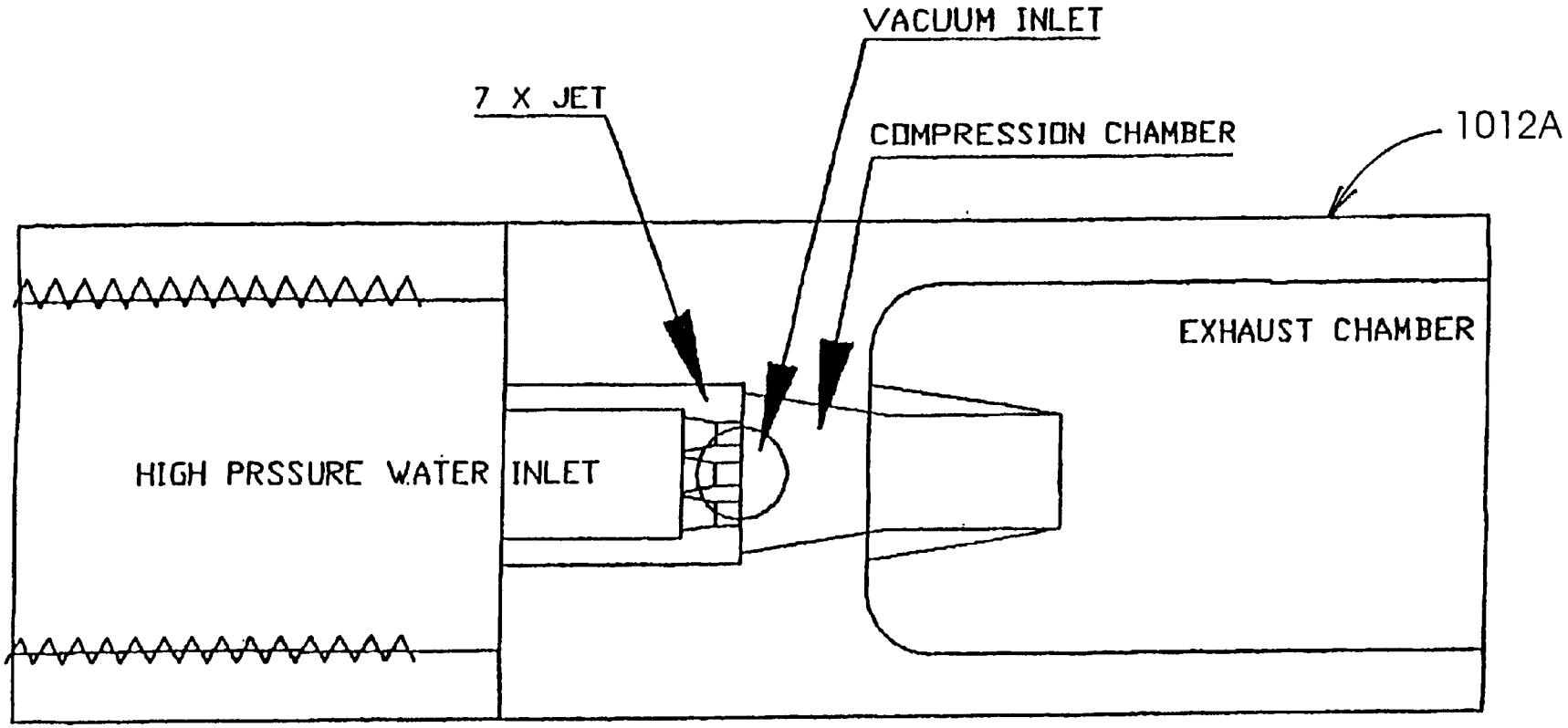

FIGS. 42 and 43 represent a modified vacuum body configuration of a fluid jet ejector 1012A. This depiction is helpful when used in comparison with FIG. 43 to describe and understand the flow of the first and second fluid through the fluid jet ejectors 1012 and 1012A.

As shown in FIG. 43, acceleration of the primary fluid through the jet insert 1014 into the diffuser 1048 creates a reduced pressure in the vacuum chamber 1046 which induces secondary fluid flow through the secondary fluid inlet 1054 into the chamber 1046. The secondary fluid thus entering the vacuum chamber 1046 is drawn and entrained by and drawn into the diffuser 1048 with the high velocity primary fluid streams from the jets 1064. The combined primary and secondary fluids undergo acceleration and compression as they pass through the convergent inlet 1050 of the diffuser 1048 and deceleration and expansion as they pass out of the cylindrical section 1052 and into the expansive outlet 1044.

In FIG. 43, it can be better understood that the shape and size of the exhaust chamber 1044 and opening 1056 can make the difference in vacuum between 29.5 In. Hg. and 5 In. Hg. of vacuum. If the exhaust chamber is the wrong shape and size, it can cause numerous little eddies of air and water. These little eddies can create an air passage from atmosphere all the way back to the vacuum chamber 1046. This can reduce vacuum by as much as 90%.

FIGS. 44–47 of the drawings show the device 1010 in operation with a back pressure assembly like that shown in FIG. 31 of the drawings.

Figure 50:
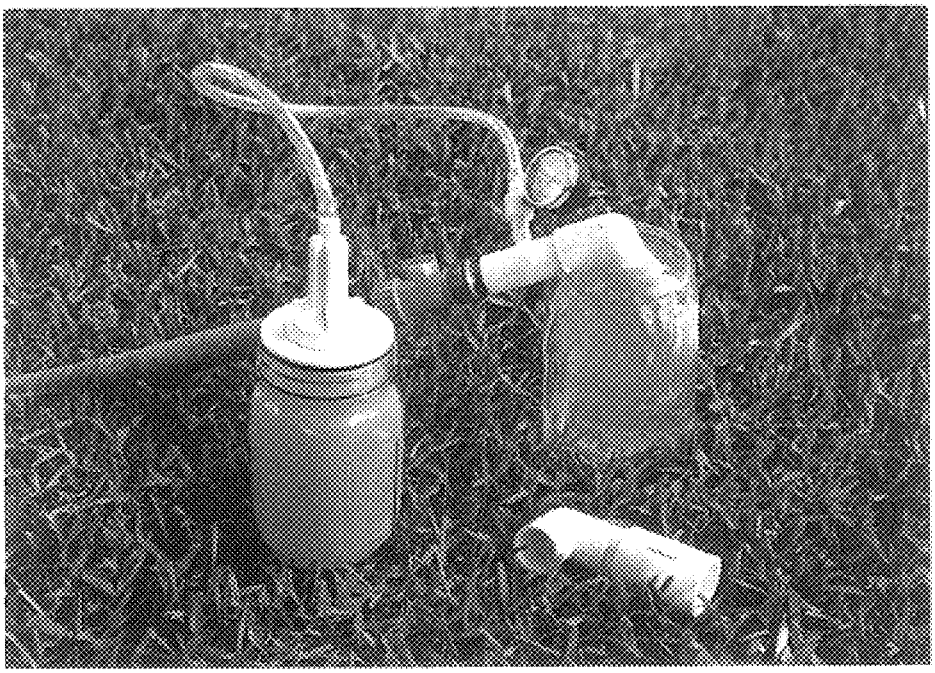
Figure 60:
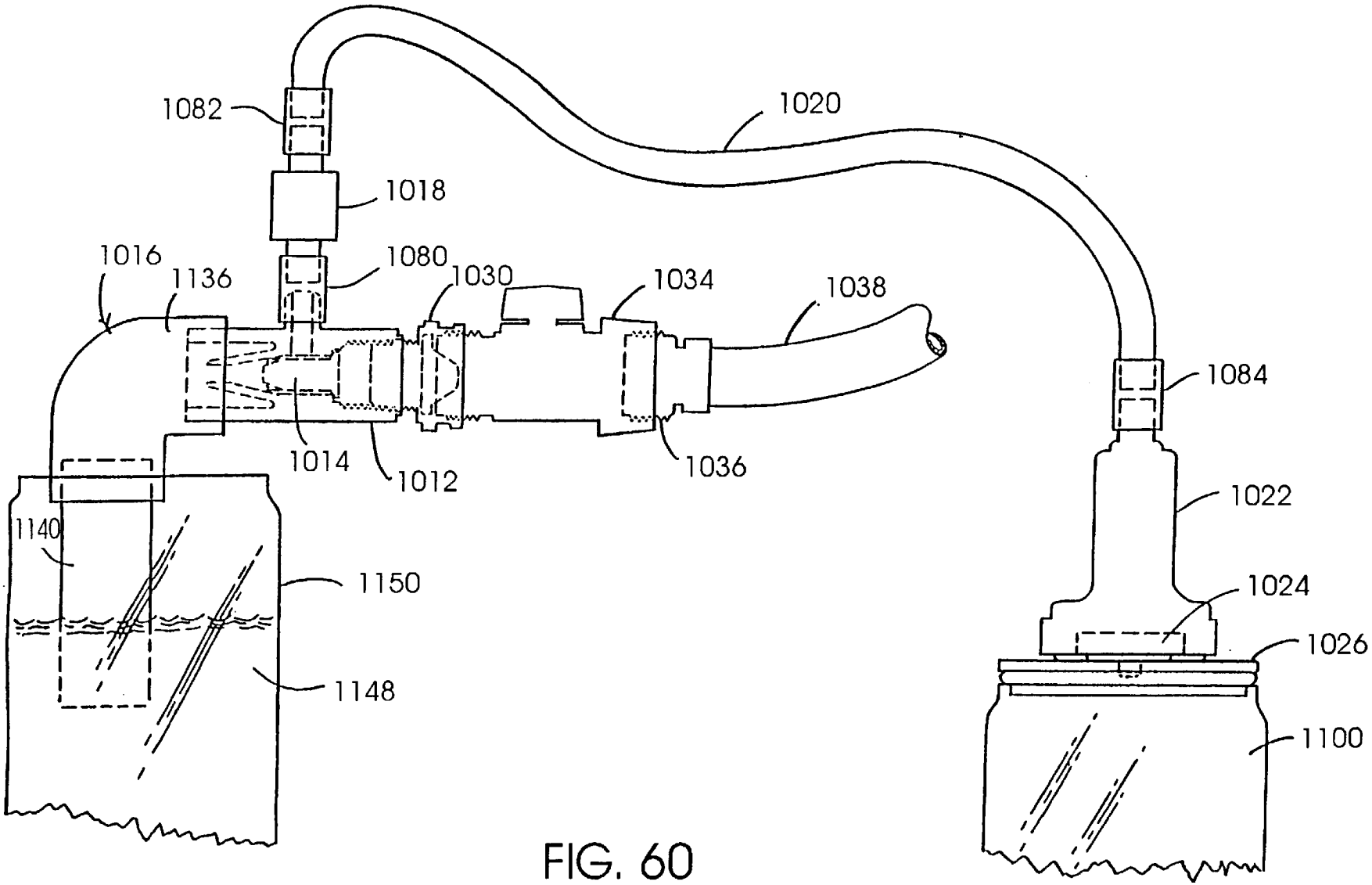

FIGS. 48–50 of the drawings show the apparatus in operation with a back pressure assembly as shown in FIG. 60 of the drawings.

Figure 51:
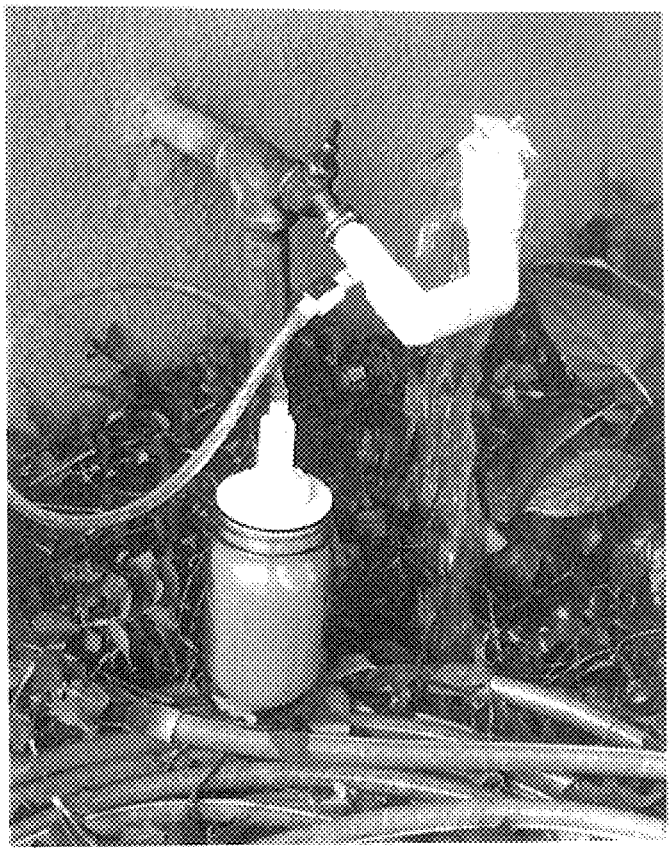

FIG. 51 of the drawings shows the device in operation with yet another selected back pressure assembly arrangement.

Figure 52:
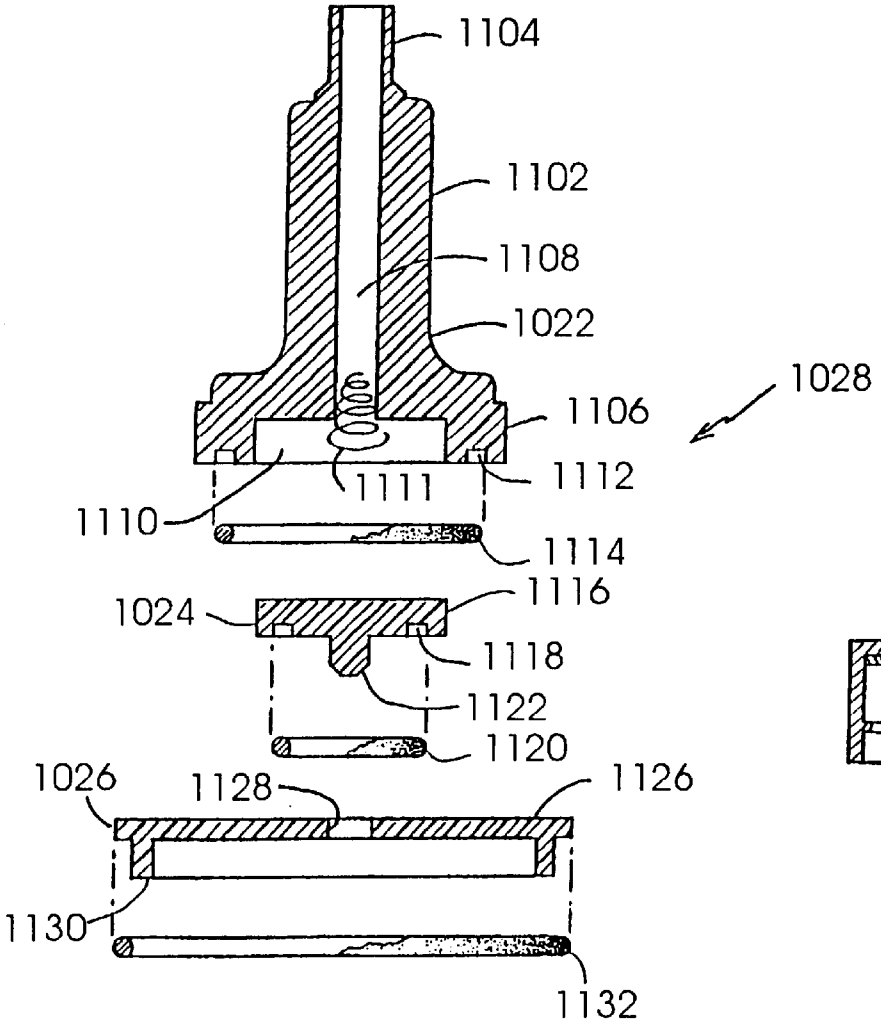
FIG. 52 is an exploded side sectional view of the lid, valve, and cap assembly of FIG. 31.

As shown in FIG. 52, vacuum cap 1022 includes an elongate handle 1102 having a small diameter cylindrical flange 1104 extending from one end and a large diameter cylindrical flange 1106 at the other end thereof. The vacuum cap 1022 includes an axial fluid passage 1108 which connects with a large diameter circular recess 1110 adapted to receive valve element or piece 1024. A spring 1111 may be added in the base of passage 1108 or in recess 1110 to provide a light spring force downwardly against the upper surface of valve element 1024. The addition of the spring 1111 may eliminate the need for the release or breaker valve 1018 since the spring presses downwardly against the valve element 1024 during removal of the vacuum cap 1022 following complete evacuation of the Mason Jar 1100. Such a spring, may prevent the release of the vacuum during removal of the vacuum cap 1022. For example, the spring 1111 applies a light downward force to the valve element 1024 during the pivoting of the vacuum cap 1022 to break the vacuum seal between the cap 1022 and lid 1026 while retaining the vacuum seal between the valve element 1024 and the lid 1026. The spring 1111 is preferably a light coiled spring press fit into the passage 1108 and/or recess 1110 and which can be easily removed and replaced for cleaning. Vacuum cap 1022 further includes an annular recess 1112 adapted to receive an O-ring or gasket 1114.

Figure 59:
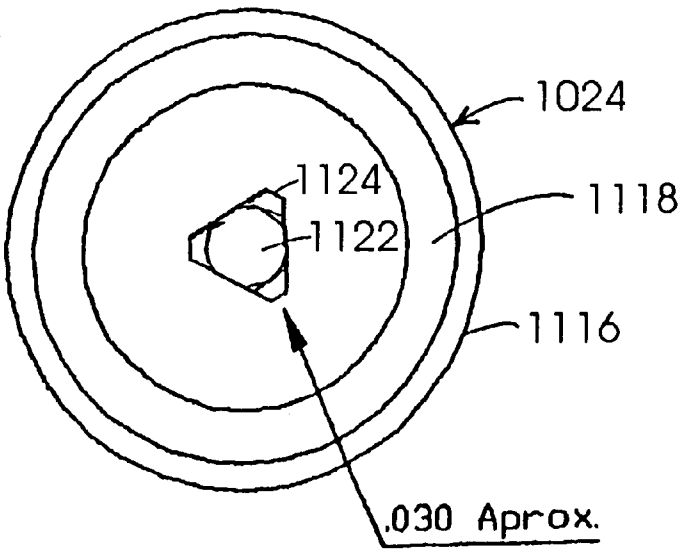
FIGS. 58 and 59 are side and bottom views of the valve which goes in the center of the jar lid.
Figure 58:
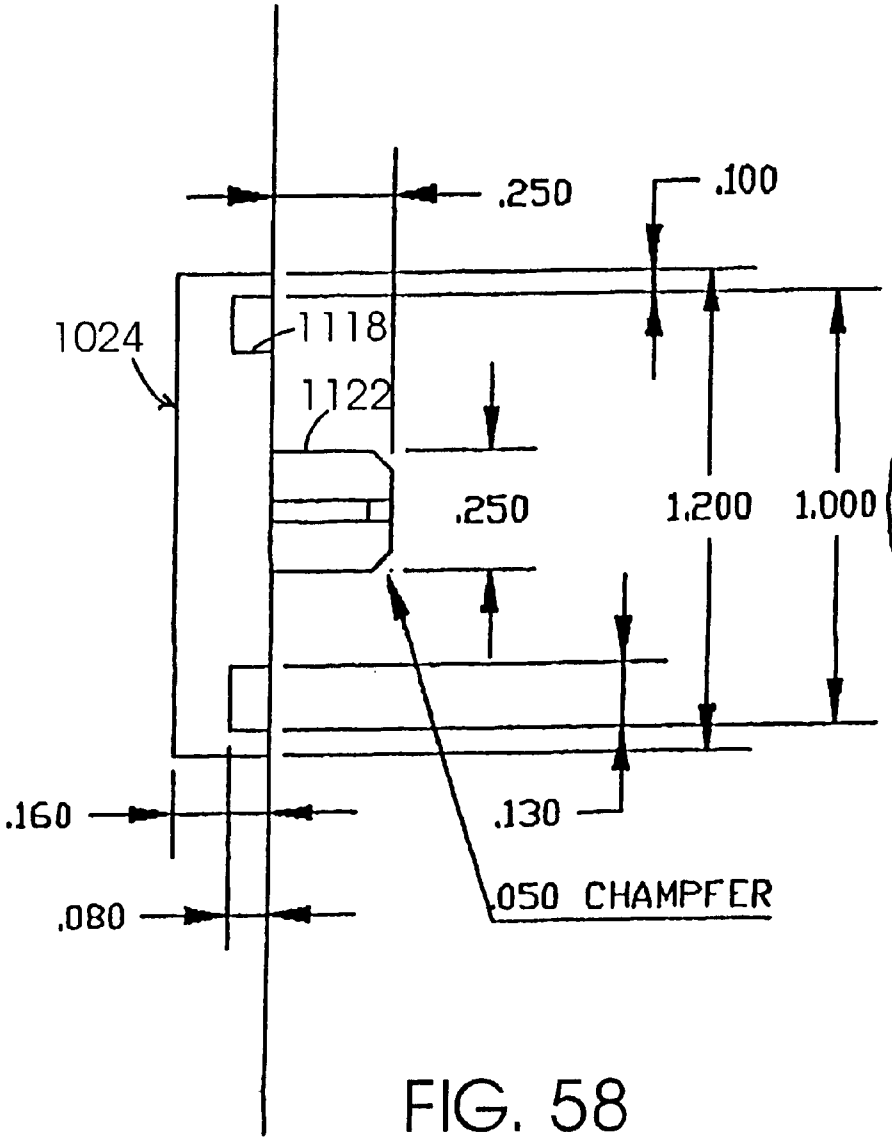

Valve piece or valve element 1024 includes a cylindrical disc 1116 having an annular recess 1118 adapted to receive an O-ring or gasket 1120 (FIG. 52). Also, the valve element 1024 includes a downwardly extending axial stud 1122 including a plurality of projections or ribs 1124 (FIGS. 58 and 59).

Figure 53:
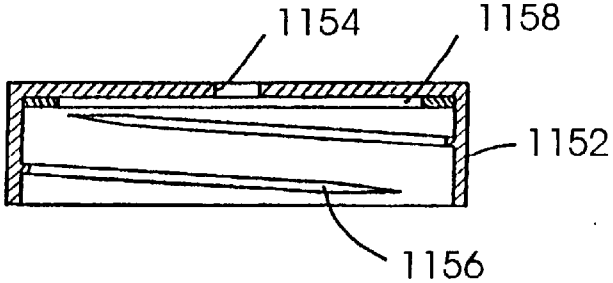
FIG. 53 is a side sectional view of a screw-on alternative Mason Jar lid that can be used in place of the lid of FIG. 52.

With reference to FIG. 53 of the drawings, a screw-on type lid 1152 includes a central circular opening 1154, internal threads 1156, and an annular resilient ring, seal or gasket 1158. The lid 1152 can be used in place of the lid 1026 with the gasket 1158 forming an airtight seal at the top of the jar or container and the opening 1154 adapted to receive the downward projection 1122 of valve element 1024.

Figure 55:
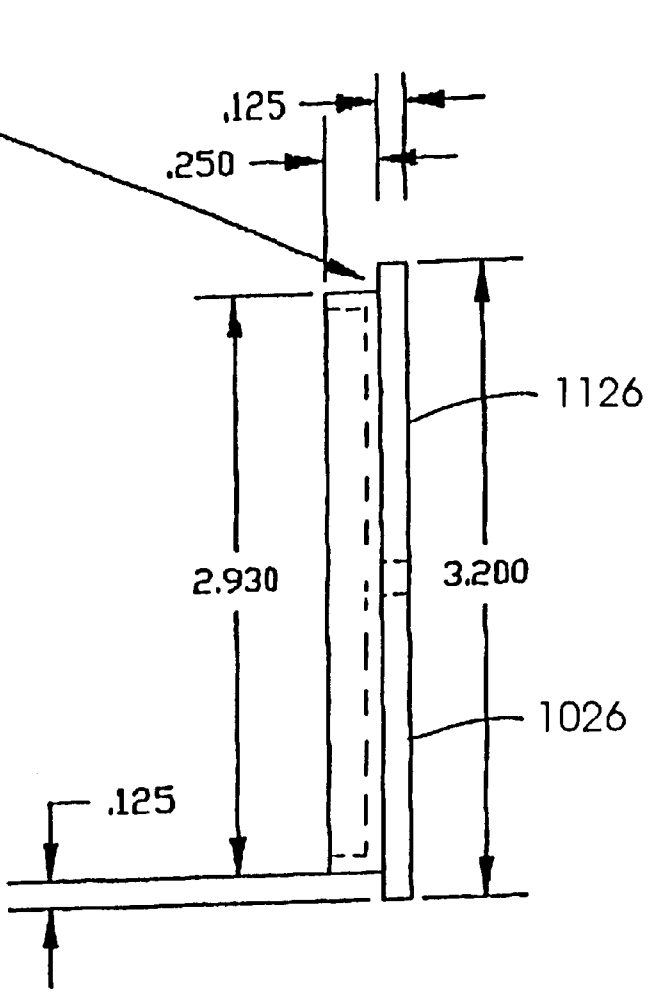
FIGS. 54 and 55 are top and side views of the jar lid that goes on top of a wide-mouth Mason Jar.
Figure 54:
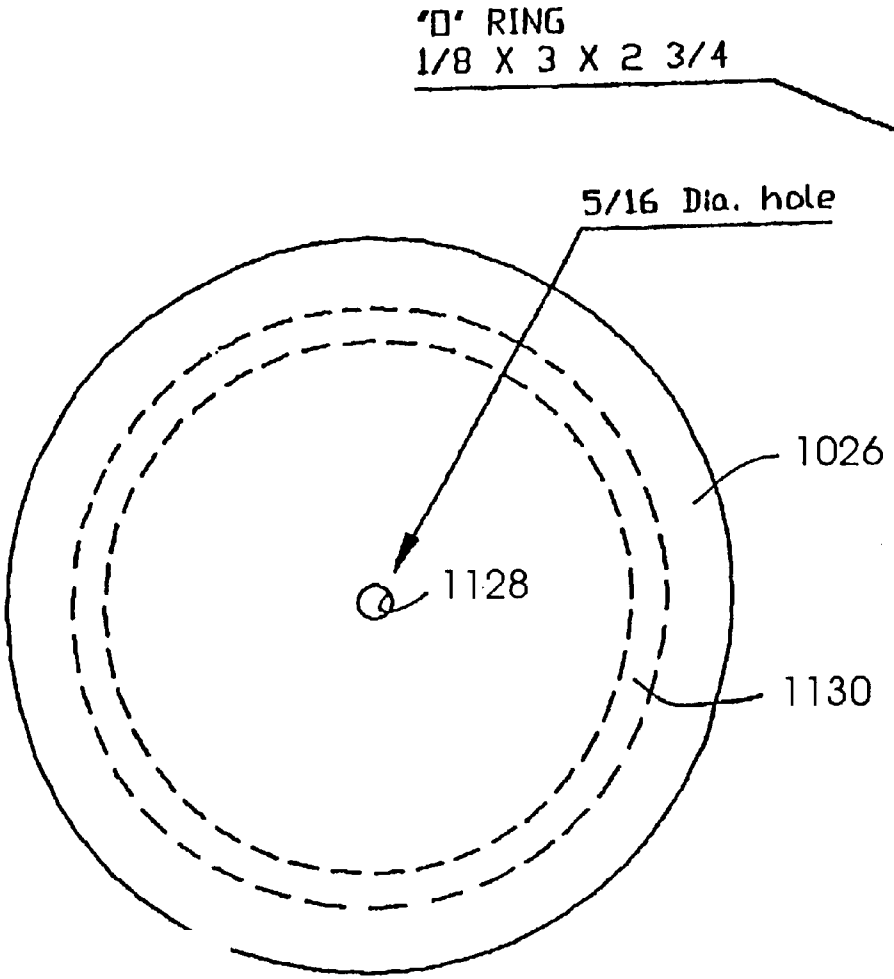

As shown in FIGS. 52 and 54–55, the vacuum lid 1026 is a circular lid adapted to cover the circular mouth of a large mouth Mason Jar 1100. The lid 1026 includes a circular plate 1126 having a small circular central opening 1128 therethrough. The circular opening 1128 is adapted to receive the stud 1122 of valve element 1024. More particularly, the ribs 1124 of stud 1122 guide the valve element 1024 to the center of plate 1126 and provide therebetween fluid passages which allow air to be drawn out of the Mason Jar 1100 up and around disc 1116 and into the recess 1110 of cap 1022. The lid 1026 further includes a cylindrical flange 1130 sized to fit within the mouth of the Mason Jar 1100 and an O-ring or gasket 1132 adapted to be received on the outer surface of the flange 1130 to form an airtight seal with the top of the Mason Jar 1100.

Figures 56, 57:
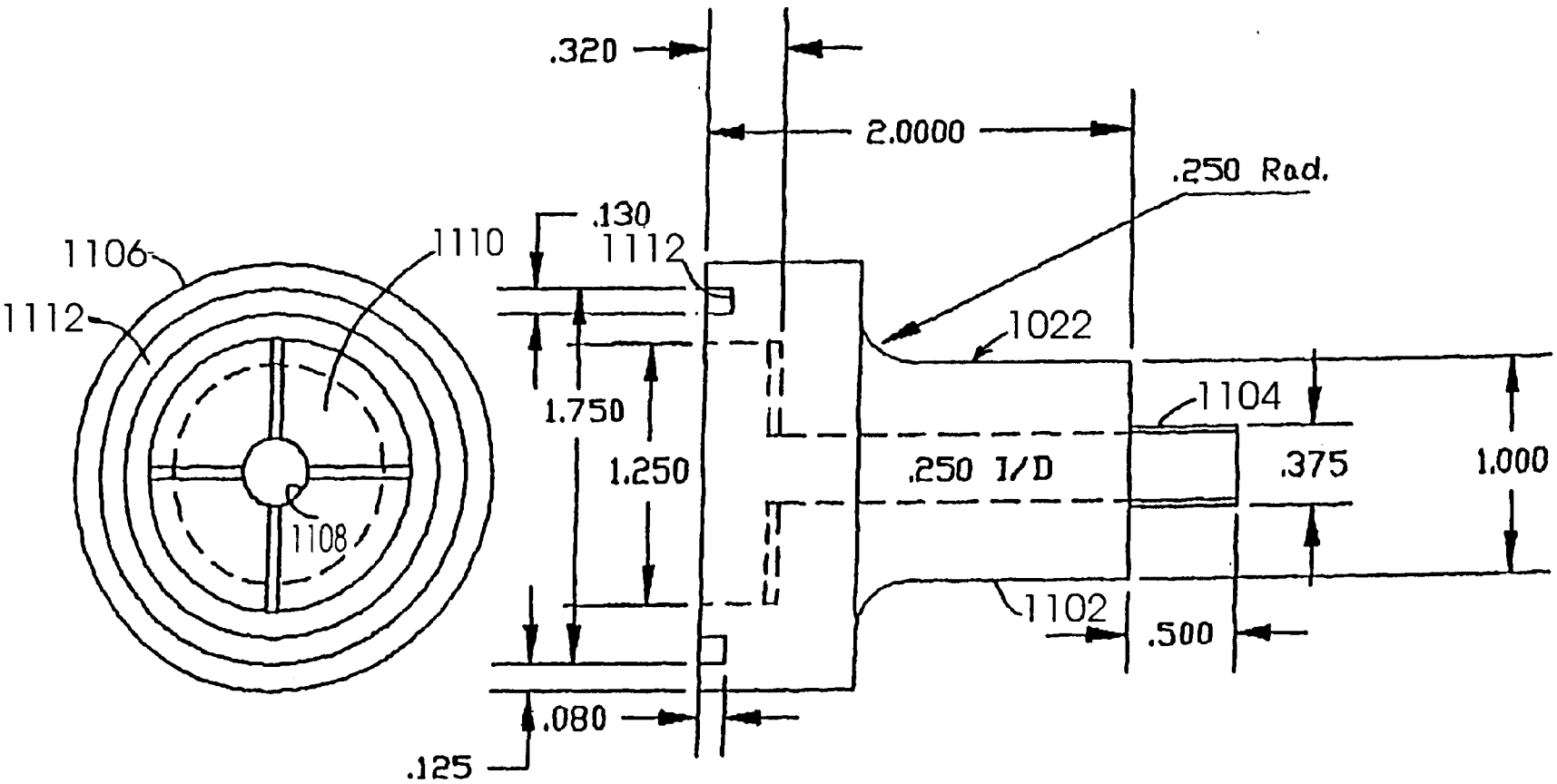
FIGS. 56 and 57 are bottom and side views of the vacuum seal cap that goes over the valve. A vacuum line runs from the top of the vacuum cap to the vacuum body through which air is vacuumed out of the jar.

FIGS. 56–57 show an example of the elongate handle 1102.

FIGS. 58–59 show an example of the valve element 1024.

With particular reference to FIG. 60 of the drawings, the back pressure assembly 1016 includes only the first elbow 1136 and the first section of straight pipe 1140 extending into liquid (water) 1148 in a Mason Jar or other container 1150. The liquid 1148 in the Mason Jar 1150 provides sufficient back pressure against the mixed primary and secondary fluids exiting pipe 1140 to allow the vacuum body 1012 and insert 1014 to produce the maximum vacuum possible.

Figure 61:
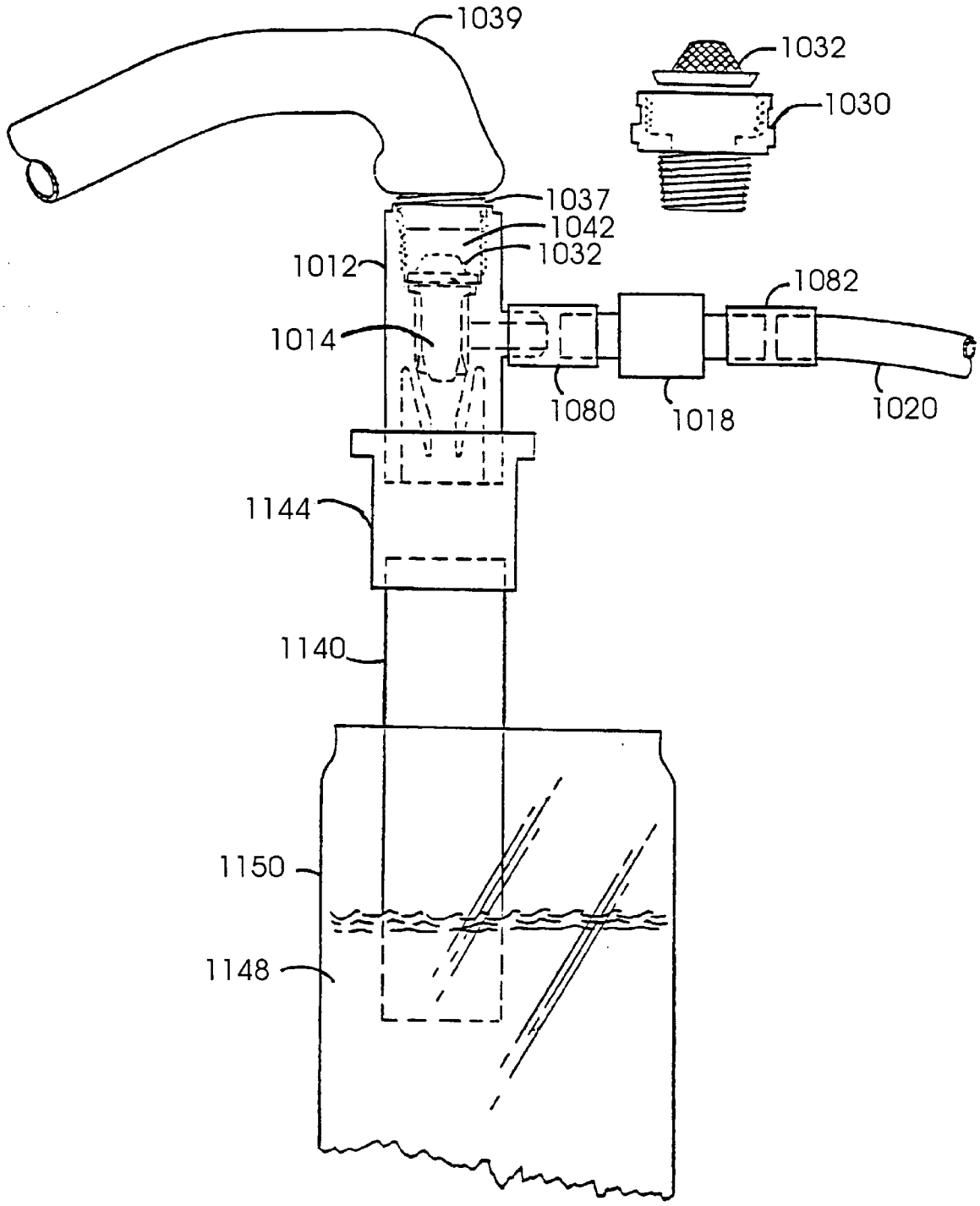

FIG. 61 depicts an arrangement similar to that shown in FIG. 60 except that the inlet 1042 of vacuum body 1012 is threadably attached to the threads of 1037 of a faucet 1039 and pipe 1140 is attached to adapter 1144. If the faucet threads 1037 are too large for inlet 1042, adapter 1030 can be used between the faucet 1039 and vacuum body 1012.

Figure 63:
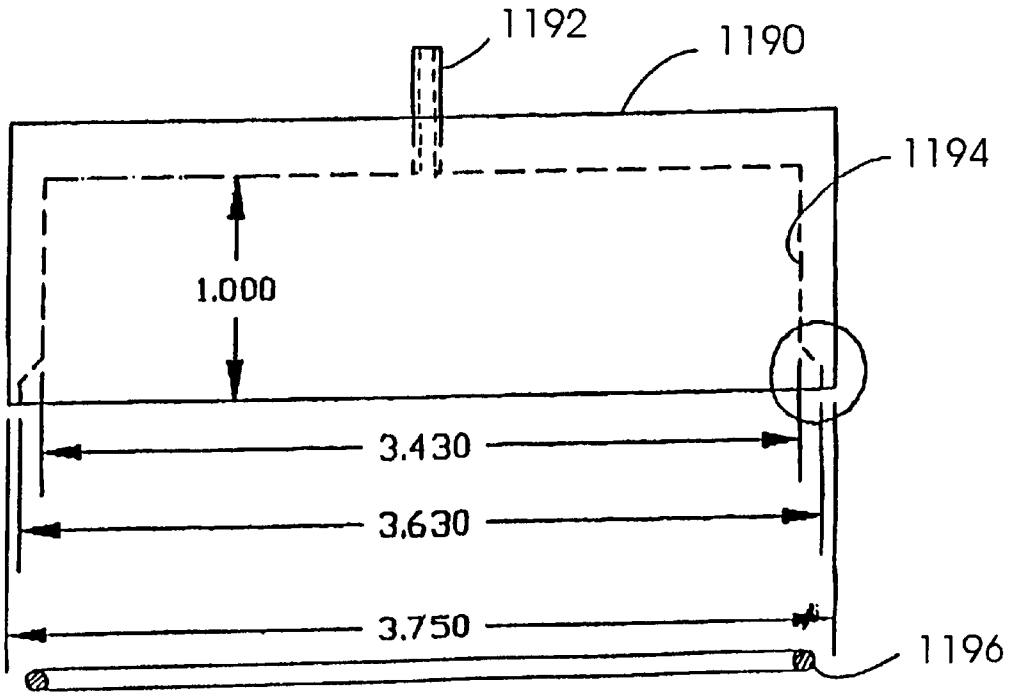
FIG. 63 is a side view of a vacuum cap adapted to fit over the top of a wide-mouth Mason Jar.
Figure 62:
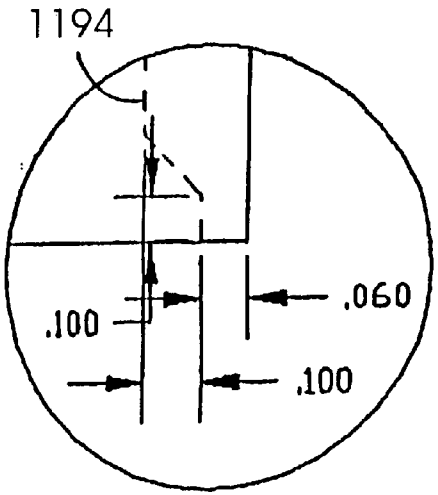
FIG. 62 is an enlarged side view of a portion of FIG. 63.

FIGS. 62 and 63 are directed to an alternative vacuum lid 1190 adapted to fit over a conventional Mason Jar having a conventional lid thereon so that the vacuum lid 1190 fits over the Mason Jar and down against an O-ring 1196 placed on the shoulder of the Mason Jar below the Mason Jar lid. With the vacuum lid 1190 placed over a Mason Jar lid, the unit can pull the air out of the jar and seal the lid. The vacuum lid 1190 includes a cylindrical vacuum outlet 1192 and a large cylindrical recess 1194 in communication with the outlet 1192 and adapted to receive the top and lid of the Mason Jar therein. The vacuum outlet 1192 is adapted to be connected to the vacuum line 1020 by a connector 1084 (FIG. 31).

Figure 64:
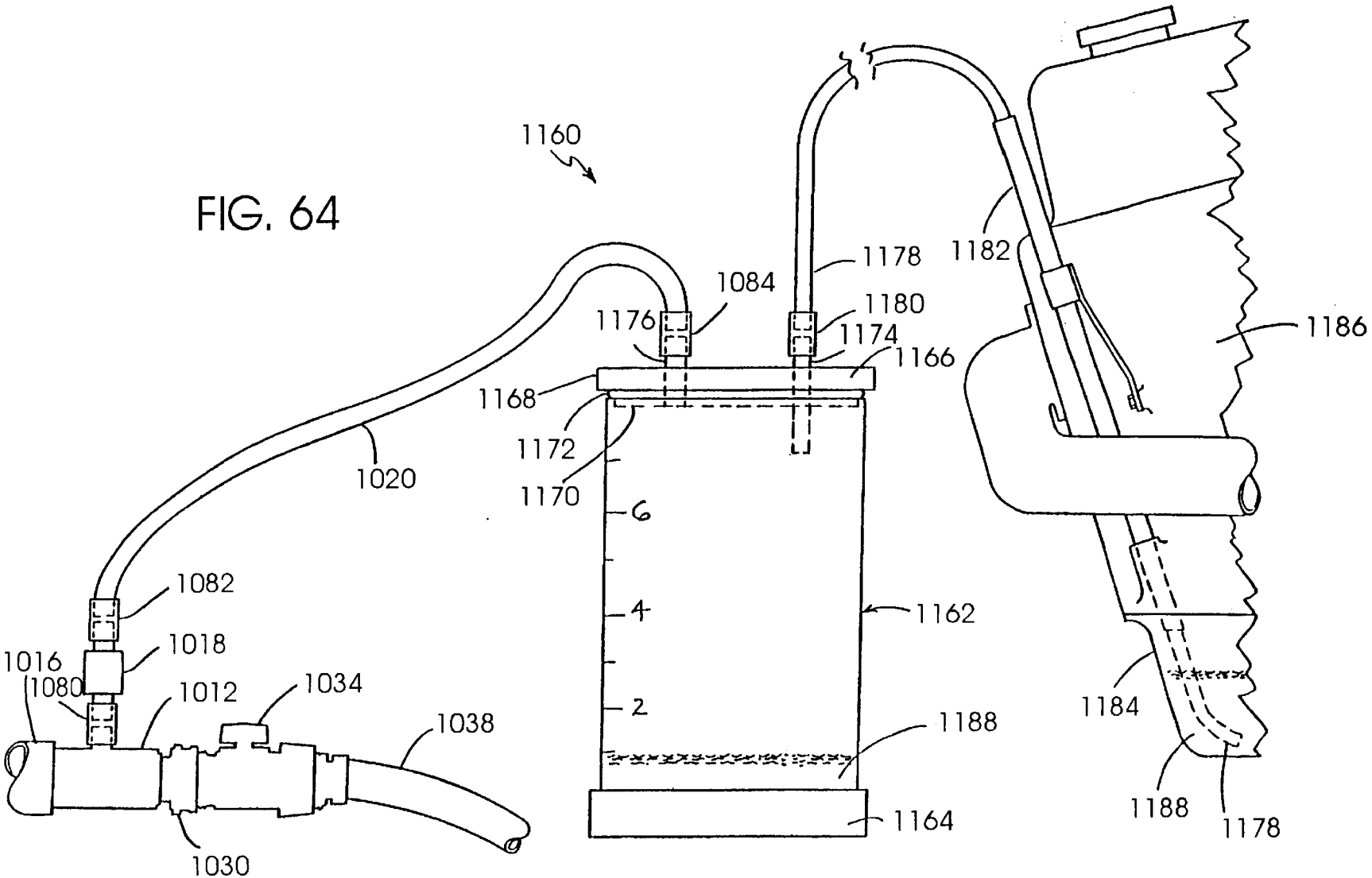

With reference to FIG. 64 of the drawings, a quick oil change kit generally designated 1160 includes a vacuum body 1012 including a jet insert 1014, a back pressure assembly 1016, a relief valve 1018, a vacuum hose 1020, an adapter 1030, a control valve 1034, and connectors 1080, 1082 and 1084. These components are the same as those of the vacuum seal kit 1010 and as such are made reference to by the same reference numerals. The oil change kit 1160 further includes a vacuum tank or oil container 1162, for example, a sturdy 2 gallon capacity plastic cylinder having a weighted base 1164 and a removable lid 1166. The lid 1166 includes a circular plate 1168, a depending circular flange 1170, and an O-ring 1172. The lid 1166 also includes a cylindrical inlet 1174 which extends through plate 1168 and into container 1162, and a cylindrical outlet 1176 adapted to receive one end of connector 1084. Oil inlet 1174 is connected to an oil line or hose 1178 by a cylindrical connector 1180. Oil line 1178 is adapted to fit through an oil dipstick tube 1182 and down into an oil pan 1184 of an engine 1186. Oil line 1178 is long enough to reach down near the bottom of the oil pan 1184 to remove substantially all of the used oil 1188 from the oil pan and draw it into container 1162.

As shown in FIG. 64 of the drawings, the kit 1160 is shown in the process of removing the used oil 1188 from the engine 1186 and as such control valve 1034 is open, water is flowing under pressure from hose 1038 through vacuum body 1012 and out exhaust assembly 1016. This creates a vacuum in line 1020 which is operatively connected to container 1162. The resultant vacuum in the container 1162 tends to draw the oil from the oil pan 1184 and into the container 1162. When all the used oil 1188 is removed from the engine, hose 1020 and line 1178 are removed from lid 1166 and the container 1162 containing the used oil 1188 may be moved to a different location for proper disposal of the used oil 1188. The valve 1034 is not closed while the vacuum hose 1020 is still attached to the container 1162, because this will allow water to be pulled into the hose 1020 and container 1162. One can tell when all of the oil 1188 has been vacuumed out of the engine by either the suction sound of air being drawn through line 1178 or the jerking back arid forth. motion of line 1178 as the last of the oil 1188 passes therethrough.

For engines (cars, lawnmowers, etc.) with a 4-quart or less oil capacity, the used oil can be vacuumed into a 1-gallon container such as a one gallon glass jug (apple juice jug). The 2-gallon container 1162 can be used as a vacuum bottle for drawing used oil or other fluid into another container such as a 1-gallon glass jug operatively placed in line 1178 between container 1162 and the engine 1186. An empty freon bottle can also be used as a vacuum bottle.

EXAMPLE PARTS LIST FOR VACUUM SEAL KIT

| ITEM # | NAME | QUANTITY |
|---|---|---|
| 1034 | Plastic Ball Valve | (1) |
| 1032 | Hose Waher/Strainer<br>CAUTION: Never operate vacuum unit without strainer. If high pressure jet gets clogged it will not work. | (1) |
| 1030 | 1/2" MPT to Garden Hose Adapter | (1) |
| 1012 | Vacuum Body (high impact polystyrene plastic, HIPS) | (1) |
| 1014 | High Pressure Jet (HIPS, pre-assembled in vacuum body)<br>CAUTION: Do not poke with screwdriver or any sharp object. If High pressure jet is damaged vacuum will be lost. | (1) |
| 1018 | Vacuum Breaker | (1) |
| 1022 | Vacuum Cap (HIPS) | (4) |
| 1024 | Vacuum Valve (HIPS) | (4) |
| 1026 | Vacuum Lid (HIPS) | (4) |
| 1100 | Wide-mouth Mason Jar<br>(Can be purchased from your local market) | (1) |
| 1020 | 3/8" × 1/4" × 2' Vacuum Line | (1) |
| 1080,1082, 1084 | 5/16" × 7/16" × 7/8" Connector | (3) |
| 1136,1138 | 3/4" PVC Elbow<br>(PVC fittings can be purchased from your local hardware) | (2) |
| 1140 | 3/4" × 4" thin wall PVC Pipe<br>(Can be used for better stability when connected to a garden hose. When unit is connected to rigid faucet, use part #14.) | (1) |
| 1142 | 3/4" × 1 7/8" thin wall PVC Pipe<br>(Either part #13 or #14 can be used depending on how unit is connected to the water supply.) | (2) |
| 1144 | 3/4" × 1" PVC Bushing | (1) |
| 1146 | 1" PVC Coupling | (1) |
| 1114 | 1 1/2" O-Ring | (1) |
| 1120 | 1" O-Ring | (4) |
| 1132 | 3" O-Ring | (4) |

EXAMPLE ASSEMBLY INSTRUCTION FOR HOME VACUUM SEALING KIT

A. Assembly Drawing FIG. 31 is an exploded view of the complete assembly.

B. To install O-Rings see Assembly Drawing FIG. 52.

C. Parts 1012, 1014, 1030, 1032 and 1034 have already been factory assembled.

D. Use washer/strainer Part 1032 even if control valve 1034 is removed. Never operate without washer/strainer! If high pressure jet becomes clogged, vacuum unit will not work.

E. Part 1014 (high pressure jet) has already been factory installed into Part 1012 (vacuum body).

F. Parts 1136 through 1146 can be pressed together (hand tight only), then you can twist the two elbows to get the angle you want on the exhaust. The most desirable angle for the exhaust is pointed straight up.

G. Part 1136 (elbow) can be pressed onto Part 1012 (vacuum body) (hand tight only).

H. Now with the entire unit assembled you can screw Part 1034 (plastic ball valve) onto the end of a garden hose.

I. If you want to use a faucet without the hose, then remove Part 1034 (plastic ball valve) and screw Part 1030 (hose adapter) onto the end of the (outdoor type) faucet.

J. Parts 1012, 1018, 1020, and 1022 are pressed together using connectors 1080, 1082, and 1084 in the same order as shown in Assembly Drawing FIG. 31.

K. The PVC ball valve 1034 is not needed if vacuum unit is hooked up to a (garden hose type) faucet. The PVC ball valve is most useful when used on the end of a garden hose. It allows you to turn the water on and off without going back to the faucet.

L. When vacuum unit is connected to a rigid water supply like a faucet, then Part 1142 offers the best stability when used between the two elbows. See Picture FIG. 78.

M. When vacuum unit 1010 is connected to a flexible water supply like a garden hose, then Part 1140 offers the best stability when used between the two elbows. See Picture FIGS. 71–74.

N. A third option on how to operate this vacuum unit: Remove everything downstream of the pipe 1040. Look at Assembly Drawing FIG. 60. See Picture FIGS. 74–77. Insert exhaust tube 1140 into a quart jar point downward but not touching the bottom. (Any container can be used, just so exhaust tube #14 discharges below the surface of the water. Watch the air bubbles boiling out of the top of the jar When there are almost no bubbles left, then you have reached a full vacuum.

The home vacuum sealing kit 1010 allows you to greatly increase the life of most food types, such as: fruits, vegetables, cold cereal, bread, cake, spaghetti, macaroni, grains, meal, sugar, etc.

Food types that normally have to be refrigerated must still be refrigerated after vacuum sealing.

Food types that normally do not need refrigeration will not need refrigeration after vacuum sealing.

The kit 1010 uses no electricity, it is small, light and has few moving parts. It will not be damaged if sugar, flour, sand, or other foreign particles (up to 0.090 Dia.) go through the vacuum line.

There are at least four different ways to install the kit 1010;

1. The control valve 1034 or adapter 1030 can be attached directly to any garden hose or outside faucet.
2. With a simple adapter, the vacuum body 1012 can be attached to the kitchen faucet. The vacuum body can exhaust straight down from the faucet into an upright container such as a Mason Jar by adding either the straight pipe 1140, 1142, and/or 1146 to the outlet 1044 using bushing 1144.
3. It can be mounted permanently on the kitchen sink, draining into the sink.
4. It can be mounted below the sink with only the vacuum line visible above the sink.

How to recognize a full vacuum:

After your vacuum kit is set up, pick a clean, flat, smooth surface like a dinner plate. With water running, place the vacuum cap 1022 on the flat surface and in just a few seconds the water exhaust will clear up from boiling white to clear flowing water with just a few tiny air bubbles left. This is the highest vacuum you can get, (about 29.5 in. Hg.).

This vacuum kit is not a toy. Keep it away from children

Never attach the vacuum cap 1022 or vacuum line 1020 to any part of the human body. This unit produces a very high vacuum (29.5 in. Hg.) and is capable of causing injury.

Do not operate this unit without an elbow or other exhaust assembly on the end of the vacuum body. Without an elbow, water leaves the vacuum body at a very high velocity and can cause bodily injury. Also, the vacuum body cannot pull maximum vacuum without an exhaust element.

The PVC ball valve is for outdoor use only and is not recommended for indoor use.

QUICK OIL CHANGE KIT

A method to vacuum all the oil from your car's oil pan through the dipstick hole using the kit 1160, in just one minute, without going under the car.

No electricity is needed.

The only power needed is a garden hose. While watering your lawn for one minute you can also vacuum the oil from your car.

Oil and water are not mixed in the kit 1160.

Another method is to use the vacuum pump and the garden hose to pull a vacuum on an 8-quart (2-gallon ) container having valved vacuum and oil ports, close the vacuum valve, disconnect the vacuum pump, carry the 8-quart container to your car, run the oil tube from the container down the dipstick hole, open the oil valve in the top of the container and in one minute all the oil is drawn into the container.

The vacuum unit of the present invention is a small, trouble-free, easy to clean, highly efficient vacuum unit for use at home, in laboratories, medical or dental facilities, food or drug processing plants, or other commercial or industrial facilities.

Figure 65:
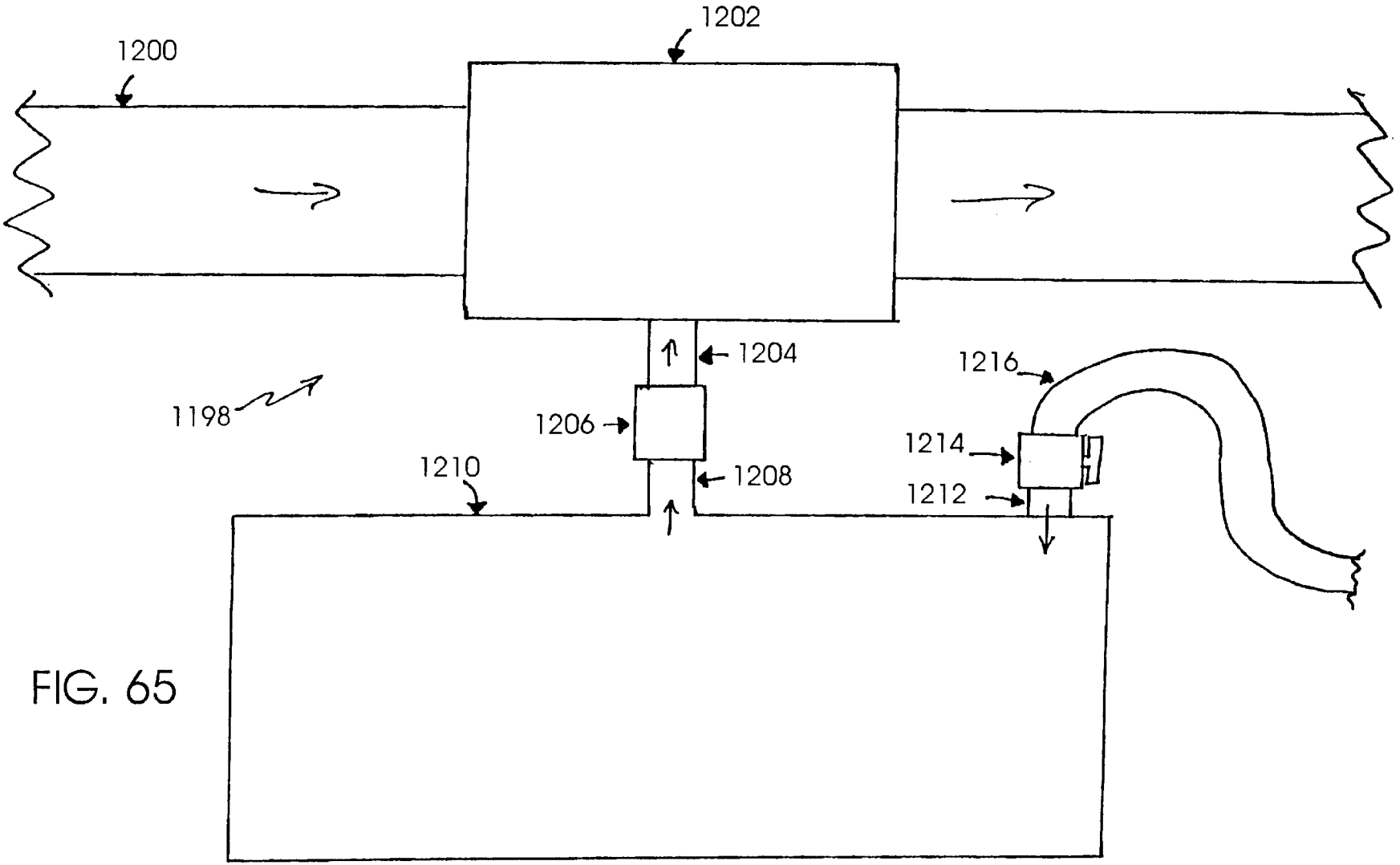
FIG. 65 is a schematic side view diagram of a device for charging a vacuum tank for storage of a vacuum charge for later use.

With reference to figure 65 of the drawings, a schematic inline vacuum system generally designated 1198 is shown to include a vacuum body 1202 placed inline in a water line 1200 of, for example, a house, factory, school, laboratory, processing plant, or the like. The vacuum body 1202 includes a secondary fluid or vacuum inlet 1204 which is operatively connected to a vacuum charge port 1208 of a vacuum tank 1210 by a check valve 1206. The vacuum tank 1210 includes a vacuum inlet 1212 operatively attached to a vacuum hose 1216 by a vacuum control valve 1214.

Anytime that water is passing through line 1200, vacuum body 1202 is producing a vacuum at secondary fluid inlet 1204 and thereby pulling a vacuum or charging the vacuum in vacuum tank 1210. Check valve 1206 prevents the flow of liquid into vacuum tank 1210. Once the tank 1210 is charged with the vacuum, one can open control valve 1214 and use vacuum hose 1216 in the same fashion as vacuum hoses 1020 of kits 1010 and 1060 or for any other purpose for which a vacuum is required. It is preferred that vacuum body 1202 be similar to vacuum body 1012, ejectors 10, 300 or 400 or vacuum pumps 500 or 502 with the size of the vacuum body 1202 being determined by the size of the water pipe 1200 and the desired vacuum in vacuum tank 1210.

Thus, it will be appreciated that as a result of the present invention, a highly effective improved vacuum apparatus and method is provided by which the principle objective, among others, is completely fulfilled. It is contemplated, and will be apparent to those skilled in the art from the preceding description and accompanying drawings, that modifications and/or changes may be made in the illustrated embodiments without departure from the present invention. Accordingly, it is expressly intended that the foregoing description and accompanying drawings are illustrative of preferred embodiments only and not limiting.

What is claimed is:

1. A vacuum seal kit comprising:

a vacuum pump with a first fluid inlet, a second fluid inlet, and a combined fluid outlet;

a back pressure assembly connected to said combined fluid outlet;

a fluid flow control valve connected upstream of said first fluid inlet;

a vacuum relief valve operatively connected upstream of said second fluid inlet;

an elongate flexible vacuum hose with a first end operatively connected to said relief valve.

2. The kit of claim 1 wherein said vacuum pump is comprised of a vacuum body and a jet insert.

3. The kit of claim 1 further comprising:

a vacuum gauge connecting in line with the vacuum relief valve.

4. The kit of claim 1 wherein said back pressure assembly creates back-pressure by redirecting the fluid flow from said combined fluid outlet.

5. The kit of claim 1 further comprising:

a back-pressure container containing a liquid wherein the flow from the combined fluid output is directed beneath the surface of said liquid.

6. The kit of claim 1, further comprising a vacuum cap, valve element, and lid assembly including:

a vacuum cap defining an axial fluid passage connected to a recess, wherein an external end of said fluid passage is adapted for connection to the vacuum hose;

a container lid sealably connected to both said vacuum cap and a container wherein said lid defines a central vacuum port opening between said recess and said container;

a valve element movably contained within said recess, adapted to be sealably connected to said lid and thereby seal the port access to said container; and, a spring element placed between one internal surface of said recess and said valve element wherein said spring element provides a spring biasing force between said cap and said valve element.

7. The kit of claim 1, wherein said vacuum pump, comprises:

a vacuum body defining a fluid passage;

a high pressure jet insert contained within said passage and further defining a high pressure primary fluid input area, at least one primary fluid jet for controlling fluid flow, a vacuum chamber, and a fluid diffusion area;

a primary fluid inlet operatively connected to said high pressure fluid input area;

a secondary fluid opening operatively connected to said vacuum chamber; and a combined fluid outlet operatively connected to said fluid diffusion area wherein said fluid outlet is capable of producing sufficient back-pressure to maximize the vacuum produced in the vacuum chamber by fluid flowing through the at least one jet.

8. A quick oil change kit comprising:

a vacuum pump with a first fluid inlet, a second fluid inlet, and a combined fluid outlet, wherein said vacuum pump is comprised of a vacuum body and a jet insert;

a back pressure assembly connected to said combined fluid outlet;

a vacuum relief valve operatively connected upstream of said second fluid inlet;

an elongate flexible vacuum hose with a first end operatively connected to said relief valve;

a fluid flow control valve connected upstream of said first fluid inlet;

a container including an oil inlet and an air cutlet, wherein said air outlet is connected to a second end of said vacuum hose;

an oil line operatively connected to said oil inlet, wherein said oil line is adapted to access oil through an oil container opening.

9. The kit of claim 8, further comprising a vacuum cap, valve element, and lid assembly including:

a vacuum cap defining an axial fluid passage connected to a recess, wherein an external end of said fluid passage is adapted for connection to the vacuum hose;

a container lid sealably connected to both said vacuum cap and a container wherein said lid defines a central vacuum port opening between said recess and said container;

a valve element movably contained within said recess, adapted to be sealably connected to said lid and thereby seal the port access to said container; and, a spring element placed between one internal surface of said recess and said valve element wherein said spring element provides a spring biasing force between said cap and said valve element.

10. The kit of claim 8, wherein said vacuum pump, comprises:

a vacuum body defining a fluid passage;

a high pressure jet insert contained within said passage and further defining a high pressure primary fluid input area, at least one primary fluid jet for controlling fluid flow, a vacuum chamber, and a fluid diffusion area;

a primary fluid inlet operatively connected to said high pressure fluid input area;

a secondary fluid opening operatively connected to said vacuum chamber; and a combined fluid outlet operatively connected to said fluid diffusion area wherein said fluid outlet is capable of producing sufficient back-pressure to maximize the vacuum produced in the vacuum chamber by fluid flowing through the at least one jet.

11. A fluid jet ejector vacuum pump comprising:

a vacuum body defining a fluid passage;

a high pressure jet insert contained within said passage and further defining a high pressure primary fluid input area, at least one primary fluid jet for controlling fluid flow, a vacuum chamber, and a fluid diffusion area;

a primary fluid inlet operatively connected to said high pressure fluid input area;

a secondary fluid opening operatively connected to said vacuum chamber; and a combined fluid outlet operatively connected to said fluid diffusion area wherein said fluid outlet is capable of producing sufficient back-pressure to maximize the vacuum produced in the vacuum chamber by fluid flowing through the at least one jet.

12. The fluid jet ejector of claim 11 wherein said fluid passage is axial to said vacuum body.

13. The fluid jet ejector of claim 11 wherein said vacuum chamber is defined by an inner wall of the vacuum body and an exterior wall of the jet insert.

14. The fluid jet ejector of claim 11 wherein said secondary fluid opening is positioned such that the secondary fluid flow entering the vacuum chamber surrounds the fluid jet insert before flowing into said diffuser area.

15. The fluid jet ejector of claim 11 further comprising:

an annular cavity surrounding said diffuser wherein said cavity has the characteristic effect of reducing the back flow of air from the outlet into the differ and vacuum chamber.

16. The fluid jet ejector of claim 11 further comprising:

alignment tabs on said jet insert wherein said tabs align the end of said insert within conical interior walls of said diffusion area and align a jet pattern to maximize the vacuum created by fluid flow through the vacuum body and jet insert.

17. The fluid jet ejector of claim 11 further comprising:

a flange on the inlet end of said insert wherein said flange is press fit to sealably hold said insert and define said primary fluid inlet and said vacuum chamber.

* * * * *